US009603777B2

(12) United States Patent
Horn

(10) Patent No.: US 9,603,777 B2
(45) **Date of Patent: *Mar. 28, 2017**

(54) CAP AND CONTAINER WITH WRITE-ON SURFACE AND WRITING IMPLEMENT HOLDER

(71) Applicant: Kimberlee Ann Horn, Romney, IN (US)

(72) Inventor: Kimberlee Ann Horn, Romney, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/522,322

(22) Filed: Oct. 23, 2014

(65) Prior Publication Data

US 2015/0108027 A1 Apr. 23, 2015

Related U.S. Application Data

(63) Continuation-in-part of application No. 14/120,427, filed on Oct. 23, 2013, now Pat. No. 9,241,870.

(51) Int. Cl.
*A61J 7/04* (2006.01)
*A61J 1/03* (2006.01)

(52) U.S. Cl.
CPC ... *A61J 7/04* (2013.01); *A61J 1/03* (2013.01)

(58) Field of Classification Search
CPC .... A47G 29/08; A61J 1/03; A61J 7/04; B65D 51/245; B65D 83/04; B65D 83/0481; B43K 23/001; B43K 23/002; G09F 2003/0273
USPC ..... 206/232, 459.1, 459.5, 528, 534, 540; 211/69.1, 69.8, 69.9; 215/230; 248/72.1, 248/74.3, 205.3, 229.1–229.26, 316.7; 40/307, 311
See application file for complete search history.

(56) References Cited

U.S. PATENT DOCUMENTS 765,439 A * 7/1904 Pike ..... B65D 55/026 40/311
1,476,629 A * 12/1923 Mcolvin ..... G09F 3/12 40/310
1,878,541 A * 9/1932 Reinhold ..... G09F 23/00 40/311
4,111,322 A * 9/1978 Obrist ..... B65D 51/245 40/311
4,913,083 A * 4/1990 Valvo ..... G09F 11/02 206/534
4,964,512 A * 10/1990 Ingram ..... G09F 3/0288 206/459.5
4,964,513 A * 10/1990 Ingram ..... G09F 3/0288 283/81
5,011,032 A * 4/1991 Rollman ..... A61J 7/04 206/534
5,031,786 A * 7/1991 Ingram ..... B65D 55/06 215/230
5,105,949 A 4/1992 Blair
(Continued)

*Primary Examiner* — Bryon Gehman
(74) *Attorney, Agent, or Firm* — James Ray & Assoc

(57) ABSTRACT

An article of manufacture includes a write-on surface configured for writing and erasing thereon, a peripheral rim extending from the write-on surface and having an interior surface thereof configured for attachment onto an open end of a container, and a holder disposed on at least an exterior surface of the peripheral rim, the holder configured to releaseably secure or retain a writing implement. A container with a writing implement holder is also provided.

21 Claims, 37 Drawing Sheets

(56) References Cited

U.S. PATENT DOCUMENTS

| | | | | |
|---|---|---|---|---|
| 5,261,702 | A | 11/1993 | Mayfield | |
| 5,743,414 | A * | 4/1998 | Baudino | B43K 23/001 211/69.1 |
| 5,947,329 | A | 9/1999 | Bailey | |
| 6,450,539 | B1 * | 9/2002 | Bilbie | B43L 1/12 283/81 |
| 6,481,127 | B1 * | 11/2002 | Bilbie | B43L 1/123 283/81 |
| 6,620,500 | B2 | 9/2003 | Sweet et al. | |
| 7,554,434 | B1 * | 6/2009 | Gifford | A61J 7/0409 215/230 |
| D675,097 | S | 1/2013 | Burke, Jr. | |
| D689,688 | S | 9/2013 | Horn | |
| 2005/0029155 | A1 | 2/2005 | Edwards | |
| 2006/0124501 | A1 | 6/2006 | McNeely | |
| 2006/0124578 | A1 | 6/2006 | Yousif et al. | |
| 2009/0031597 | A1 * | 2/2009 | Powell | G09F 3/04 40/310 |
| 2009/0314680 | A1 | 12/2009 | Gifford | |
| 2010/0065201 | A1 * | 3/2010 | Means | G09F 3/0288 40/311 |
| 2012/0138563 | A1 * | 6/2012 | Brumfield | B65D 51/18 215/230 |
| 2012/0170966 | A1 | 7/2012 | Novak | |
| 2012/0223045 | A1 | 9/2012 | Burke, Jr. | |
| 2012/0305177 | A1 | 12/2012 | Simmons et al. | |
| 2014/0209489 | A1 | 7/2014 | Horn | |
| 2014/0224236 | A1 | 8/2014 | McPherson | |

* cited by examiner

CAP AND CONTAINER WITH WRITE-ON SURFACE AND WRITING IMPLEMENT HOLDER

CROSS-REFERENCE TO RELATED APPLICATIONS

This application is a Continuation-In-Part (CIP) of a non-provisional patent application Ser. No. 14/120,427 filed by Inventor Kimberlee Ann Horn on Oct. 23, 2014, now Issued as U.S. Pat. No. 9,241,870 B2 and incorporated in its entirety by reference.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

1. Technical Field

The subject matter relates to tracking at least one of date, time, consumption and/or usage dosage or quantity, and description of contents in a container. It further relates to tracking at least one of date, time, and dosage of medicine.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, one of the recommendations to reduce medication errors and harm is to use the "Five Rights of Medicine Administration": the right patient, the right drug, the right amount, the right route, and the right time. However, the five rights should be accepted as a goal of the medication process not the "be all and end all" of medication safety. It is important to follow the rules of the "Five Rights of Patient Medication Administration" to keep the patient safe and prevent harm. Medical professional errors can often occur in the medical field, and utilizing the "Five Rights" points can help to avoid these errors.

It may be also important for every medical professional and/or caregiver to be knowledgeable about the medication being given to the patient. It may not be possible for every medical professional to know the drug facts on every drug. To be safe and competent, the medical professional may look up unfamiliar drug information before giving the medication to the patient. The patient has the right to information on the medication, the right to receive the correct medication, and the right to have a medical professional knowledgeable in the medication they are providing. Examples of the "Five Rights of Medicine Administration" may include:

Right Patient—Be sure you have the right patient before administering medication; Ask the patient to state their full name.

Right Medication—Check the bottle's label against the physician's authorization; Be sure they match.

Right Amount—Double check the amount of medication before administering; Be sure the amount to be given is clearly understood.

Right Time—Medication is to be given in substantial compliance with the physician's request; Within one half hour before or after the scheduled time.

Right Route—Designated medical professionals are authorized to administer oral medication only; Do not administer ear, eye, nose drops, topical medication, or injected medication.

Generally, the right amount, right day and right time may be the most important parameters associated with consumption of medicine, particularly of the prescription type.

Typically, medicine may include a special food or a chemical that makes someone better when they are ill. A lot of medicines are liquids and can be bought in a small bottle. Other medicines may come in pills or capsules. The doctor may tell the patient or caregiver how much medicine to take each day. Most medicines cannot be bought unless a doctor (or other authorized professional) has prescribed the medicine for the patient. Often, the doctor or pharmacist provide specific instructions for administering the medicine, including dosages, quantities, and warnings.

Typically, medicine containers are containers that contain medicine prescribed by doctors. Medicine containers come in different shapes, sizes, and colors. The most common is an orange pill bottle, opaque liquid bottle or a pill box.

Typically, dosage forms are a mixture of active drug components and nondrug components. Depending on the method of administration they come in several types. These are liquid dosage form, solid dosage form and semisolid dosage forms. Various dosage forms may exist for a single particular drug, since different medical conditions can warrant different routes of administration. Additionally, a specific dosage form may be a requirement for certain kinds of drugs, as there may be issues with various factors like chemical stability or pharmacokinetics. The oral and intravenous doses of a medicine may also vary depending on the patient, the strength of the medication, and the severity of the illness.

Although Applicant's previous efforts improved medicine dispensing record system by providing a medicine container or a cap with a built-in or integrated marking or mark-on surface, further improvements have been found necessary, particularly in enabling attachment of a writing implement and protecting marked information from being unintentionally or accidentally removed or distorted.

It may be also necessary to track consumption and/or storage of contents that are not related to medications, for example such as prepared foods.

DETAILED DESCRIPTION OF THE INVENTION

Figure 2:
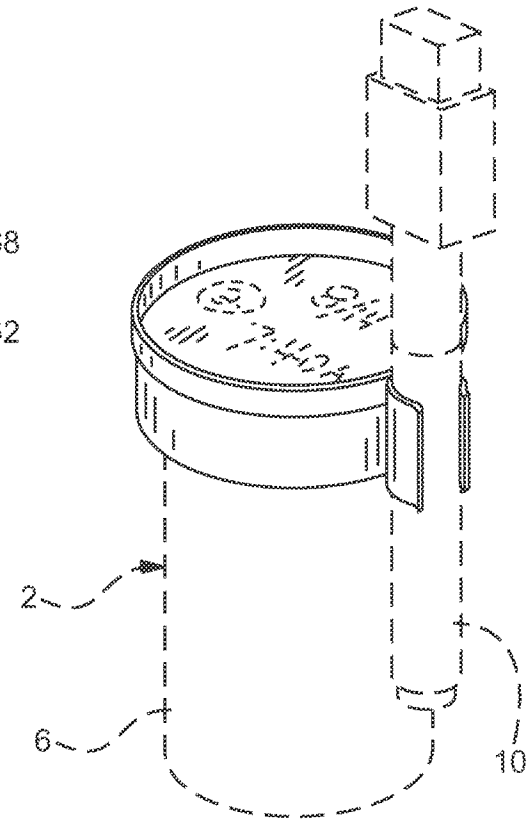
FIG. 2 illustrates a perspective environmental view of the cap of FIG. 1 in a combination with a container and a writing implement, both shown in broken lines.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," "interior," "exterior," and derivatives thereof shall relate to the invention as oriented in the Figures. Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The subject matter relates to tracking information. The subject matter may relate to tracking at least one of date, time, consumption and/or usage dosage or quantity, and description of contents in a container. The subject matter may generally relate to a medicine dispensing tracking and provides for ease of tracking either date, time and dosage of consumed medicine or the date, time and dosage of to be consumed medicine. The user may also track the name of the medicine content itself. The related information may be recorded in an erasable or permanent manner by any marking or writing implement on a write-on surface provided either on a surface of a container or a cap operable to close an open end thereof.

The invention provides an article of manufacture that has a write-on surface at least partially configured, sized and/or shaped to receive indicia thereon without binding and/or being absorbed thereby. A peripheral rim may extend from the write-on surface and may have an interior surface thereof configured for attachment onto an open end of a container. The article of manufacture may also provide a holder so as to releasably attach and/or retain a writing implement operable to adhere such indicia.

When concerned with medicine consumption, the invention provides an article of manufacture configured for an attachment to an exterior surface of a medicine container or to an open end of the medicine container to selectively cover and uncover the open end thereof. The medicine may be any one of pills, tablets, capsules, liquids, patches, creams, ointments, eyedrops, eardrops, buccals, dissolving medicine, effervescents, aerosols, suspensions, emulsions, topicals, chewable, sublinguals, reconstitutables and injectables type related to prescriptions, over-the-counter medications, vitamins and/or supplements, and the like. The invention also provides a novel container, for example such as a medicine container, configured to releaseably retain a writing implement thereon or therein.

Now in a particular reference to FIGS. 1-7, therein is illustrates a cap or an article of manufacture 20 for selectively covering and uncovering an open end of a container 2.

The cap 20 includes a member 30 having a working or a write-on surface 32, a first peripheral rim 40, an engagement 80 between an interior surface 42 of the first peripheral rim 40 and an exterior surface 6 of the container 2, a second peripheral rim 50 upstanding above the write-on surface 32 and a clip or holder 60 disposed on an exterior surface 44 of the first peripheral rim 40 and/or an exterior surface 54 of the second peripheral rim 50. The holder 60 is shaped and sized to releaseably retain or hold a writing implement 10.

The first peripheral rim 40 is illustrated as being manufactured from a non-transparent (light-resistant, non-translucent, opaque) material, although a transparent material, as described further in the exemplary embodiment of FIGS. 14-20, is also contemplated by the invention.

The member 30, in this and other exemplary embodiments, may include a rigid member 34 defining a base or a substrate of the member 30 and a generally thin member 36 configured to be attached to the base or substrate 34 either in any one of a permanent, a semi-permanent and a releaseable manner by any conventional attachment means. By way of one example only in FIG. 1*a*, the member 36 may be attached with an adhesive 38. The member 36 may be attached to the base 34 with the adhesive 38 in the releaseable or peelable manner, so that the user may replace the member 36 and the write-on surface 32 either due to wear thereof, due to unintended use of permanent type markers or pens or simply to change a pre-printed portion of the indicia identifier 19 when such pre-printed portion is provided. By way of another example, such conventional attachment means may also include mechanical processes, for example such as clamping, friction fit, molding and the like attachment arrangements. For example, the outer peripheral edge of the member 36 may be sized to frictionally fit an interior surface 52 of the second peripheral rim 50. The outer peripheral edge of the member 36 may be also sized to be slightly less than the size of the interior surface 52 so as to allow ease of removal of the member 36.

The write-on surface 32 may be fabricated from a material that does not adhere or bind to indicia identifier 19, including, without limitation, a dry-erase surface, a melamine surface, porcelain, painted steel, and hardened laminate. The write-on surface 32 may be reused a multiplicity of times to reflect subsequent day, time and/or dosages of the medicine. The indicia identifier 19 is configured to adhere to any of the described write-on surfaces without binding and/or being absorbed by any of the write-on surfaces in this document. In some examples, the indicia identifier 19 may include, without limitation, a dry-wipe marker ink, an erasable ink, eraser mate inks, and toluene and xylene based inks. In some examples, the indicia identifier 19 may be a nontoxic erasable ink that easily and quickly erases from the write-on exterior surface.

Any of the described write-on surfaces in this document may be provided, in alternative examples, as a stack of "Post-it"®. Notes wherein the indicia identifier 19 may be of also provided of a permanent type.

The member 36 and/or the write-on surface 32 of the dry-erase type may be provided as a coating on the base 34 as taught in U.S. Pat. No. 6,620,500, whose teachings are incorporated herein by reference thereto. Briefly, such dry erase member for receiving and releasably retaining a write-on composition comprises a substrate coated with a layer of dry erase material on a first face thereof. In specific embodiments, the dry erase coating includes a major amount of a fluorinated polymer or a cell lose acetate based polymer, together with a minor amount of a melamine resin. The dry erase member may be flexible.

The member 36 and/or the write-on surface 32 of the dry-erase type may be also taught in application Ser. No. PCT/US2000/031750, whose teachings are incorporated herein by reference thereto. For example, the taught dry erase laminate structure, the rigid substrate can be the above described base 34 and the taught thin plastic sheet having a substantially smooth, hard upper surface, and a nonporous 'UV' hardcoat film bonded to the upper surface of the plastic sheet, thereby providing a glass-like exposed writing surface, ca be the above described member 36.

The second peripheral rim 50 can extend above the write-on surface 32 so as to at least minimize if not completely prevent an accidental contact with the indicia identifier 19. The indicia identifier 19 may be one of a preprinted, molded, write-on and any combinations thereof.

The holder 60 at least extends along a height of the first peripheral rim 40 and may optionally extend along a height of the second peripheral rim 50.

Figure 1:
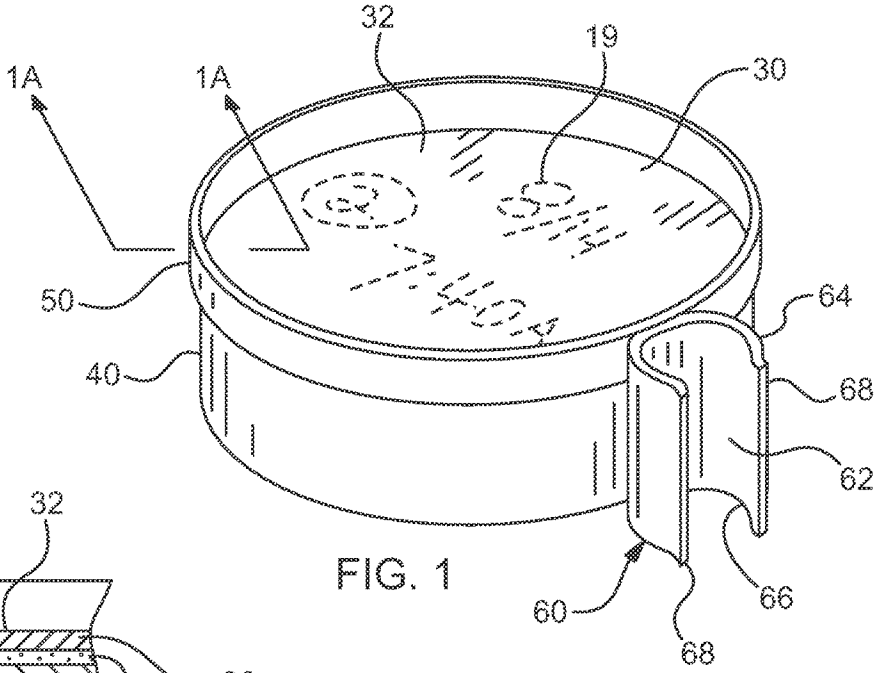
FIG. 1 illustrates an exemplary perspective view of a cap with a write-on-on surface and a writing implement holder.
Figure 1A:
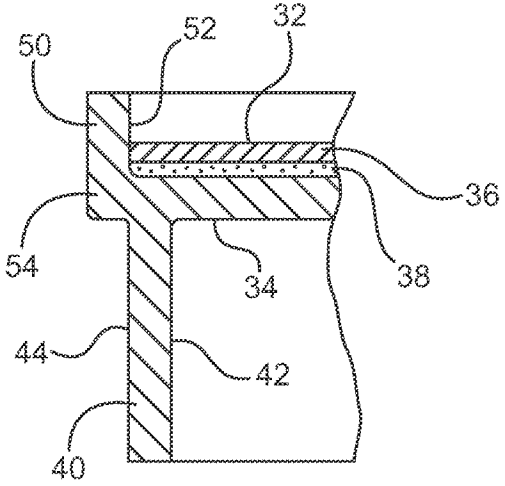
FIG. 1A illustrates a partial cross-sectional view of the cap along lines 1A-1A of FIG. 1.
Figure 3:
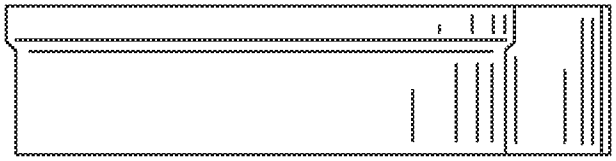
FIG. 3 illustrates a front view of the cap in FIG. 1.
Figure 4:
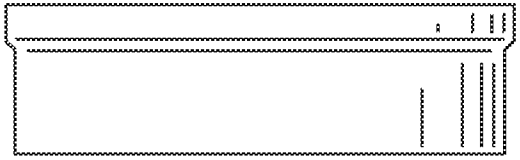
FIG. 4 illustrates a left side view of the cap in FIG. 1.
Figure 5:
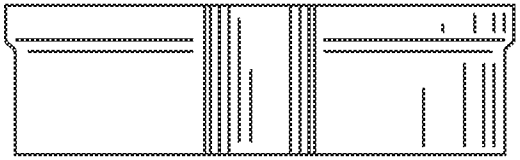
FIG. 5 illustrates a right side view of the cap in FIG. 1.
Figure 7:
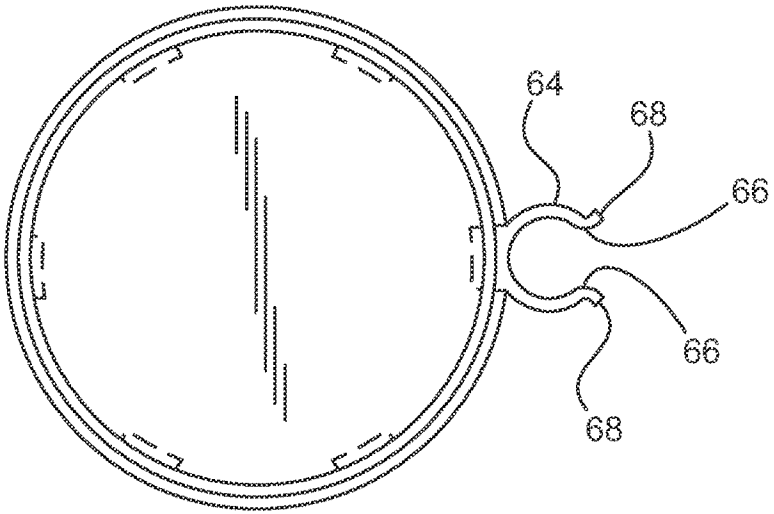
FIG. 7 illustrates a bottom view of the cap in FIG. 1.
Figure 6:
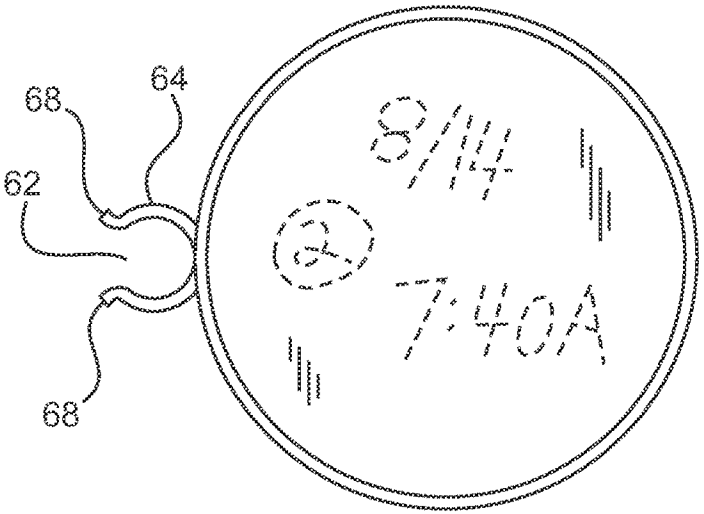
FIG. 6 illustrates a top view of the cap in FIG. 1.
Figure 9:
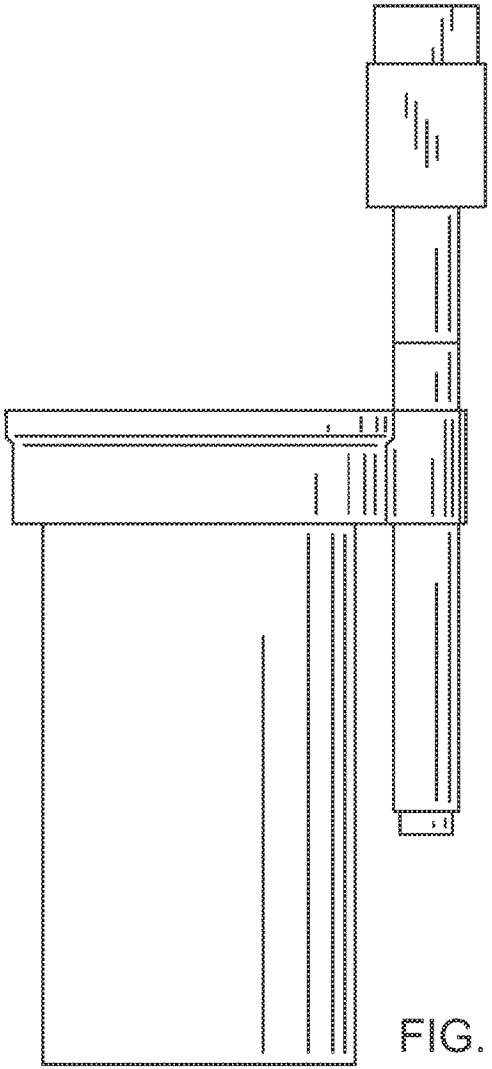
FIG. 9 illustrates a front view of the system in FIG. 8.
Figure 8:
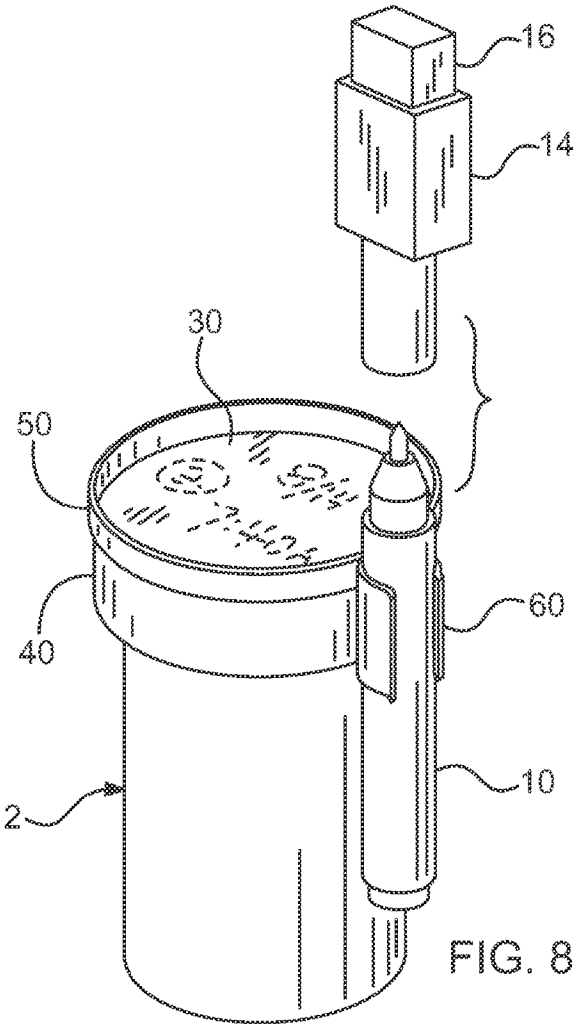
FIG. 8 illustrates an exemplary perspective view of an assembly including a container, a cap with a write-on surface and a writing implement, partially exploded, wherein the cap engages an open end of the container.
Figure 11:
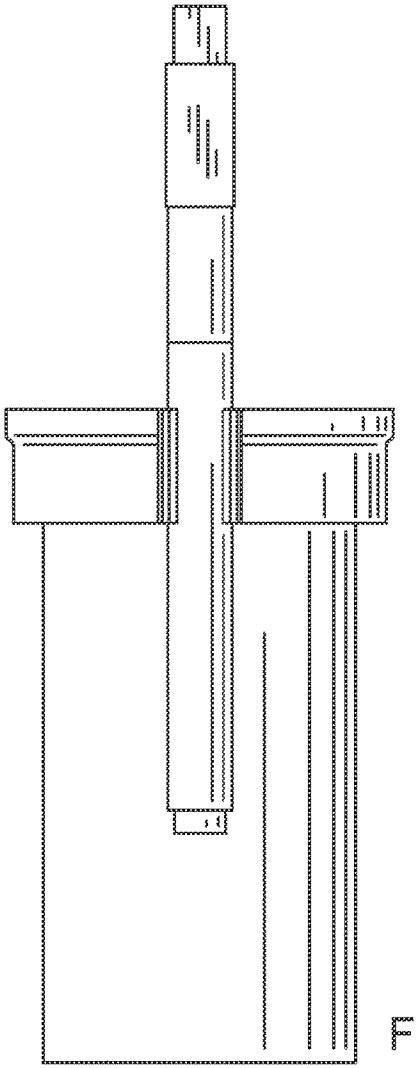
FIG. 11 illustrates a right side view of the system in FIG. 8.
Figure 10:
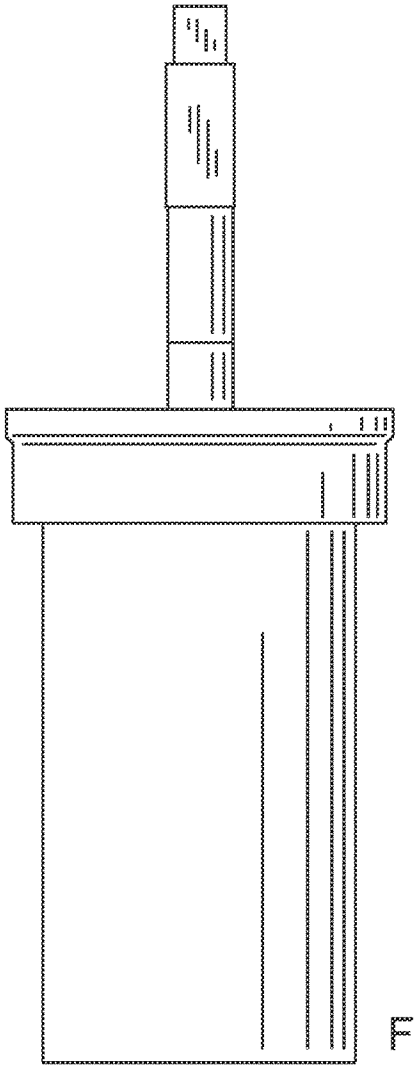
FIG. 10 illustrates a left side view of the system in FIG. 8.
Figure 13:
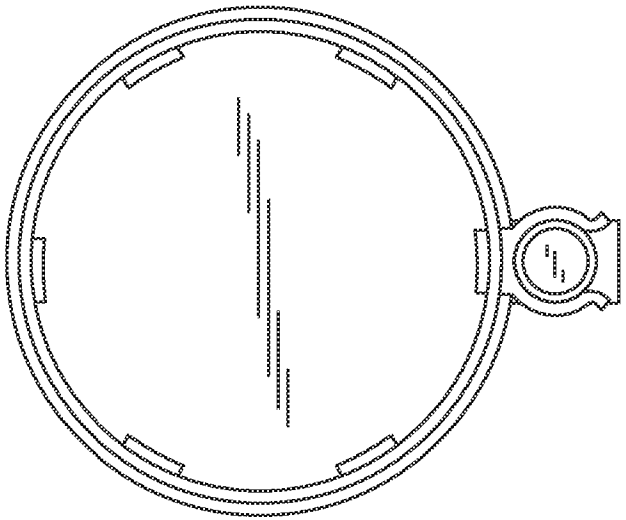
FIG. 13 illustrates a bottom view of the system in FIG. 8.
Figure 12:
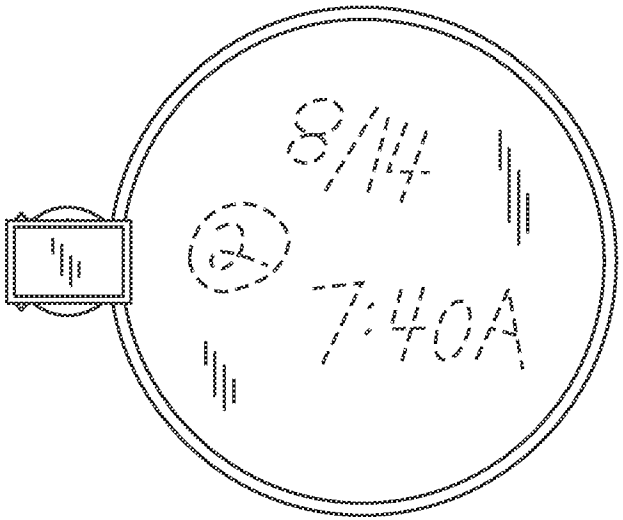
FIG. 12 illustrates a top view of the system in FIG. 8.
Figure 15:
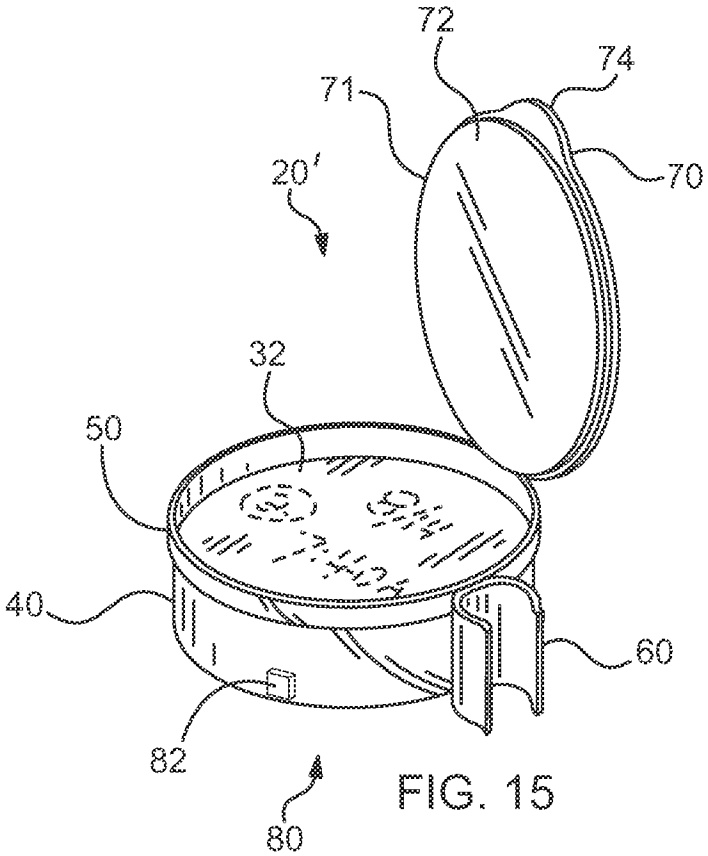
FIG. 15 illustrates another perspective view of the cap of FIG. 14 with a protective lid in an open position.

The holder 60, in this and other exemplary embodiments, includes an opening 62 facing away from the exterior surface. Furthermore, a cross-sectional shape of the holder 60 in a plane parallel to a plane of the member 30 and its write-on surface 32 includes a first curved portion 64 abutting exterior surface 44 of the first peripheral rim 40, a pair of second curved portions 66 that define a narrow opening of the holder 60 and that may terminate in a pair of flanges 68, as is best shown in FIGS. 1 and 6-7. At least the second curved portions 66 may move or flex during insertion and removal of the writing implement 10 through the opening 62. At least the second curved portions 66 and even the entire holder 60 may be manufactured from one of a flexible material, a resilient material and a combination thereof.

Alternatively, the holder 60 may include an annular cross-sectional shape in a plane parallel to a plane of the write-on surface. In this exemplary embodiment, the holder 60 may be manufactured from a flexible and resilient material defining a tubular shape thereof or may be manufactured from a rigid material. In yet another exemplary embodiment, the holder 60 may be provided as a pouch or a pocket.

Thus, the holder 60 can include any cross-sectional shape suitable for releaseably retaining the writing implement. In either exemplary embodiment the holder 60 provides a releasable and secure retention for the writing implement 10 that can be easily and repetitively inserted into and removed from the opening 62.

The base or substrate 34, first and second peripheral rims, 40 and 50 respectively, may be manufactured as a one-piece unitary construction. The holder 60 may be provided as a separate member, being attached for example with adhesives (not shown) or the holder 60 may be also manufactured with the base or substrate 34, first and second peripheral rims, 40 and 50 respectively, as a one-piece unitary construction.

FIGS. 1-7 also illustrate (when presented without reference numerals and further in a conjunction with the relevant Brief Description of the Drawings) an ornamental design for a cap with a write-on surface and a writing implement holder. The broken lines representing the container and the writing implement are for environmental purposed only and form no part of the claimed ornamental design. The claimed cap can be used on a medicine container for tracking day, time and/or dose of medicine consumption, where the tracking information is written on the write-on surface.

It is also contemplated that the cap 20 of FIGS. 1-7 may be manufactured from a transparent material as described further in the exemplary embodiment of FIGS. 14-20.

FIGS. 8-13 illustrate an assembly including the container 2 having a closed end, an axially opposite open end and a peripheral surface; the above described cap or article of manufacture 20 including a write-on surface 32, a first peripheral rim 40 adapted for a releaseable coupling to an open end of the container 2, a second peripheral rim 50 upstanding above the write-on surface 32, and a clip or holder 60 for releaseably retaining or holding writing implement 10; and the writing implement 10 that may also include a cap 14 with an eraser 16 and being configured, for example, as a dry-erase marker.

FIGS. 8-13 also illustrate (when presented without reference numerals and further in a conjunction with the relevant Brief Description of the Drawings) an ornamental design for an assembly comprising a medicine container, a cap with a write-on surface and a writing implement holder and the writing implement.

FIGS. 14-20 illustrate another exemplary embodiment of the cap or article of manufacture 20' that includes the write-on surface 32, the first peripheral rim 40 adapted for the releaseable coupling to an open end of the container 2, the second peripheral rim 50 upstanding above the write-on surface 32, a clip or holder 60 for releaseably retaining or holding the writing implement 10.

The first and second peripheral rims, 40 and 50 respectively, are illustrated as being manufactured from a transparent (light transmissive, light permeable, clear, translucent) material. Such material may be polypropylene and tinted, for example such as amber, to conform with the light-permeation/transmission standards specified in the United States Pharmacopeia (USP) Standard 24 <661> while sufficiently transmissive in the remainder of the visible spectrum. Polypropylene tends to be somewhat cloudy, and thus may need to undergo a standard clarification process in order to become sufficiently transmissive so as to allow viewing therethrough. Such material may be also high-density or low-density polyethylene.

Furthermore, the cap 20' in this exemplary embodiment comprises a lid 70 selectively movable between a first position, wherein a surface 72 thereof is being positioned generally coplanar with a plane of the write-on surface 32 so as to prevent an access thereto and a second position being disposed at an acute, right or obtuse angle to the plane of the write-on surface 32 so as to allow the access thereto. The lid 70 may include a smaller portion 71, sized and shaped to fit, either by a friction fit, a snap fit or a loose fit, into the interior of the second peripheral rim 50. Alternatively, the smaller portion 71 may be defined by a cavity allowing the cap 70 to receive exterior surface 54 of the second peripheral rim 50. The lid 70 may also include a pull tab 74 that extends beyond the exterior surface 44 of the first peripheral rim 40 when the lid 70 is in the first position.

The lid 70 may be manufactured from the above discussed transparent material.

Figure 14:
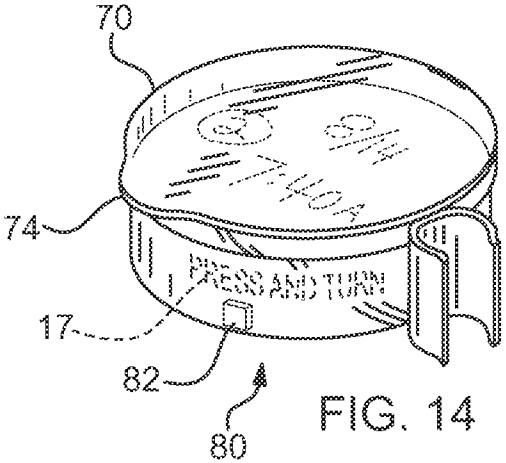
FIG. 14 illustrates another exemplary perspective view of a cap with a write-on surface.
Figure 17:
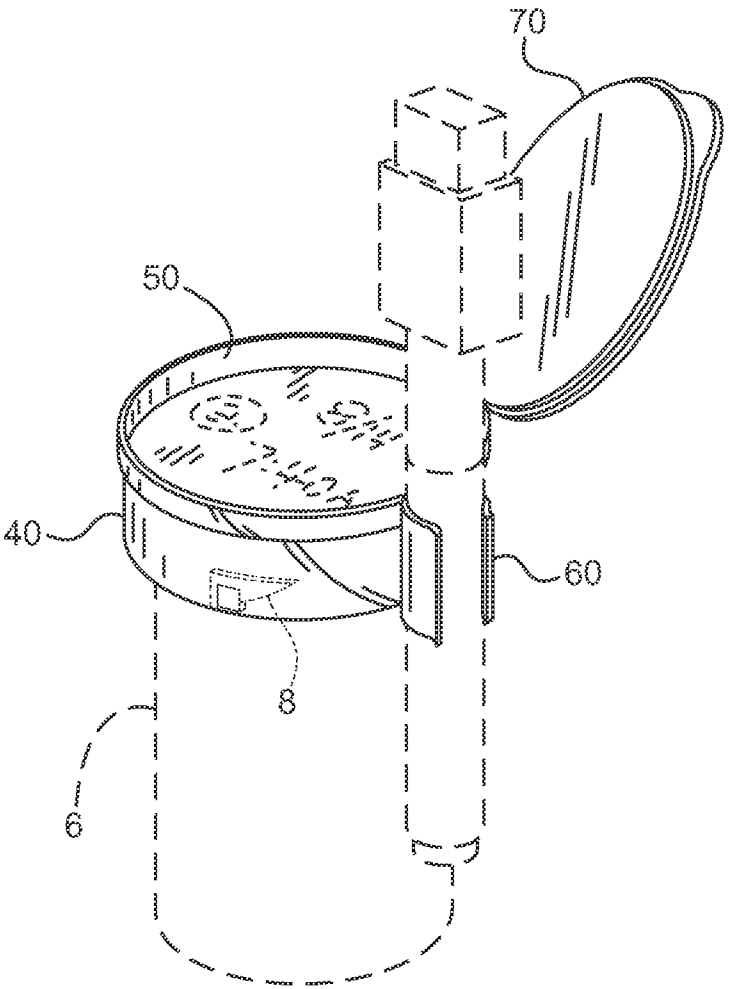
FIG. 17 illustrates a perspective environmental view of the cap of FIG. 15 in a combination with the container and the writing implement, both shown in broken lines.
Figure 16:
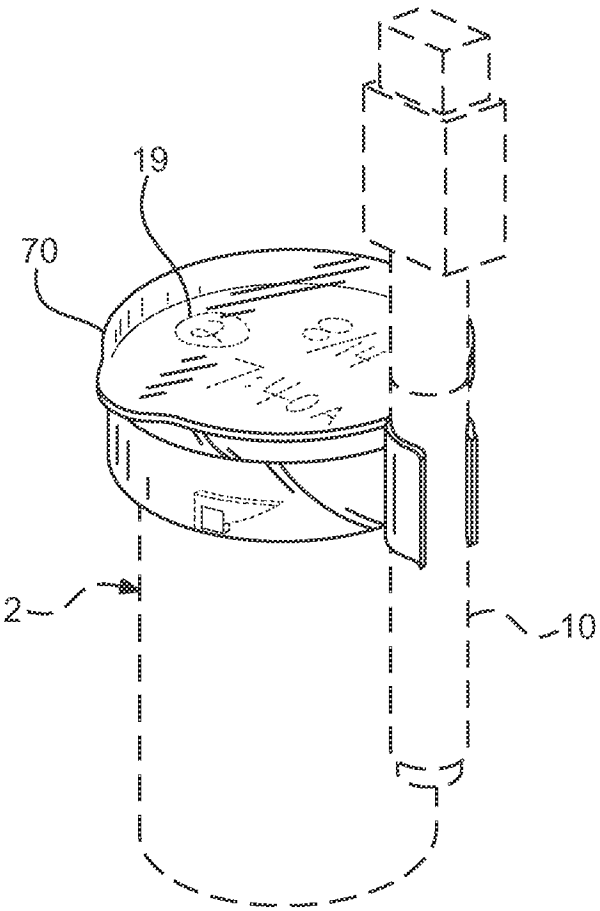
FIG. 16 illustrates a perspective environmental view of the cap of FIG. 14 in a combination with a container and a writing implement, both shown in broken lines.
Figure 19:
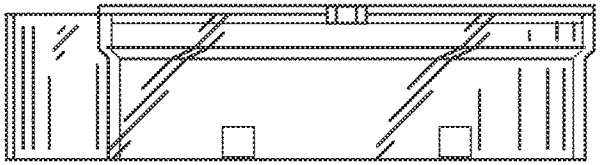
FIG. 19 illustrates a rear view of the cap in FIG. 14.
Figure 22:
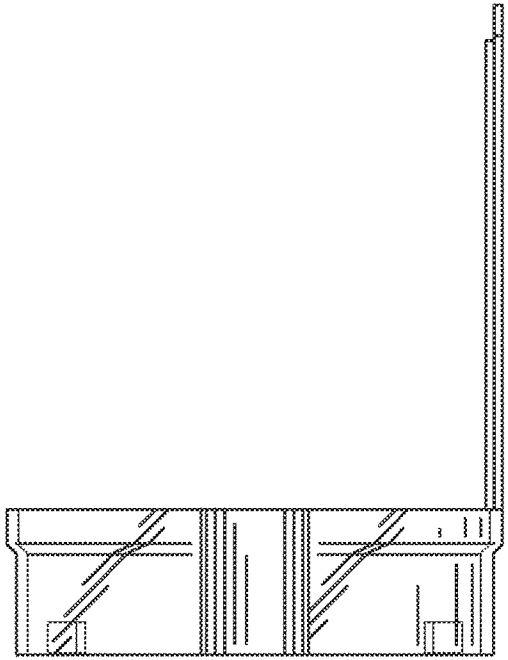
FIG. 22 illustrates a right side view of the cap in FIG. 15.
Figure 20:
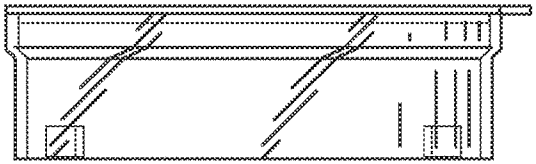
FIG. 20 illustrates a left side view of the cap in FIG. 14.
Figure 18:
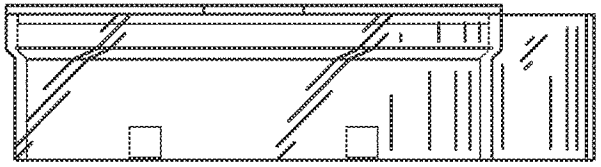
FIG. 18 illustrates a front view of the cap in FIG. 14.
Figure 21:
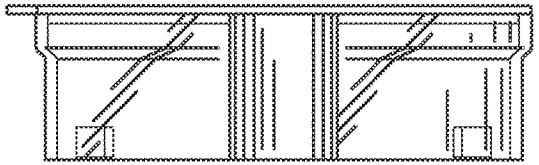
FIG. 21 illustrates a right side view of the cap in FIG. 14.
Figure 24:
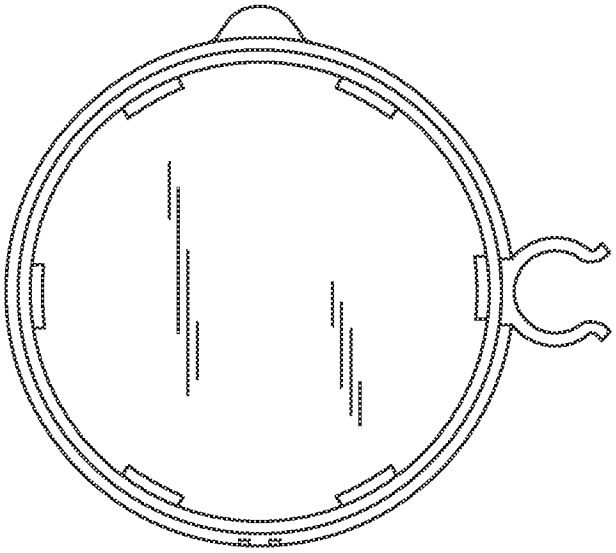
FIG. 24 illustrates a bottom view of the cap in FIG. 14.
Figure 23:
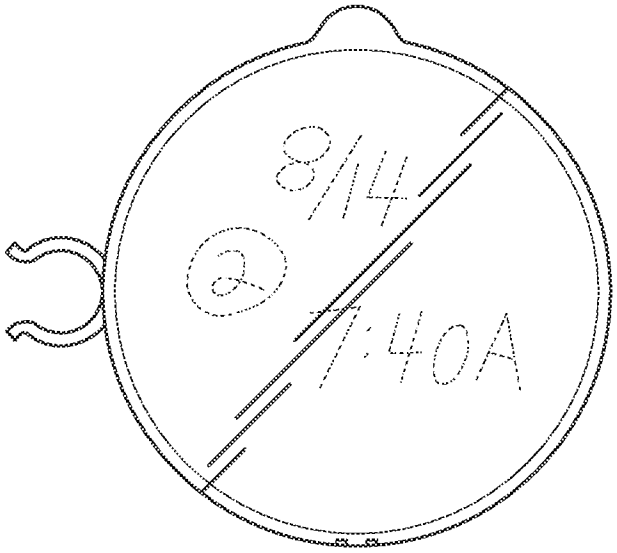
FIG. 23 illustrates a top view of the cap in FIG. 14.
Figure 26:
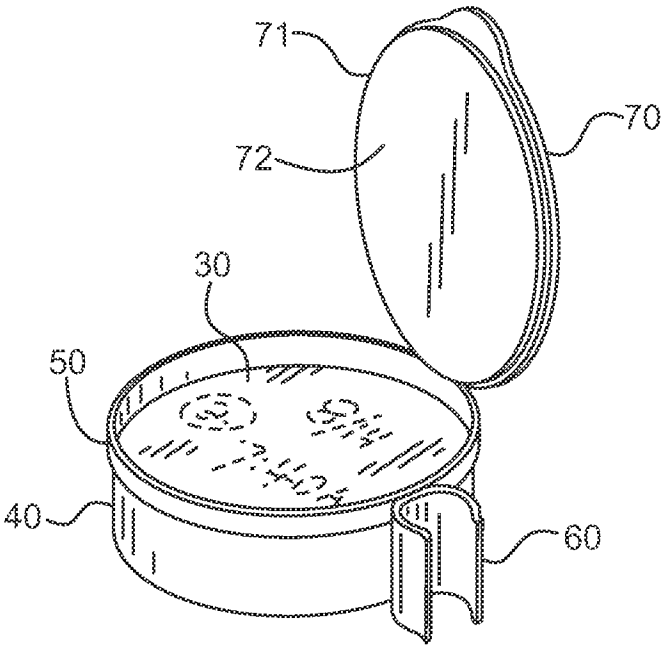
FIG. 26 illustrates another perspective view of the cap of FIG. 25 with a protective lid being in an open position.
Figure 25:
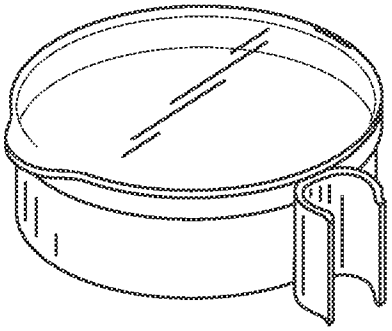
FIG. 25 is yet another exemplary perspective view of a cap with a write-on surface and a writing implement holder.
Figure 28:
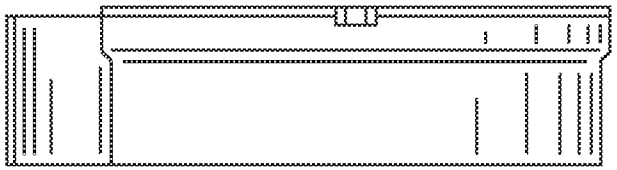
FIG. 28 illustrates a rear view of the cap in FIG. 25.
Figure 27:
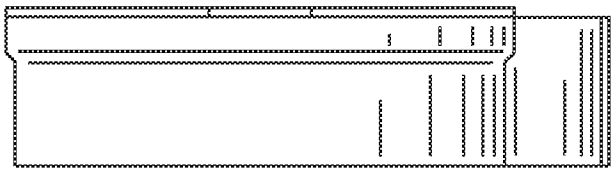
FIG. 27 illustrates a front view of the cap in FIG. 25.
Figure 29:
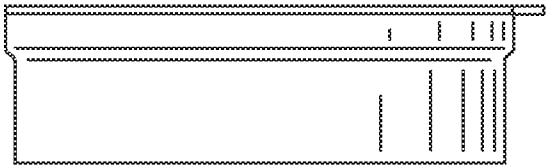
FIG. 29 illustrates a left side view of the cap in FIG. 25.
Figure 31:
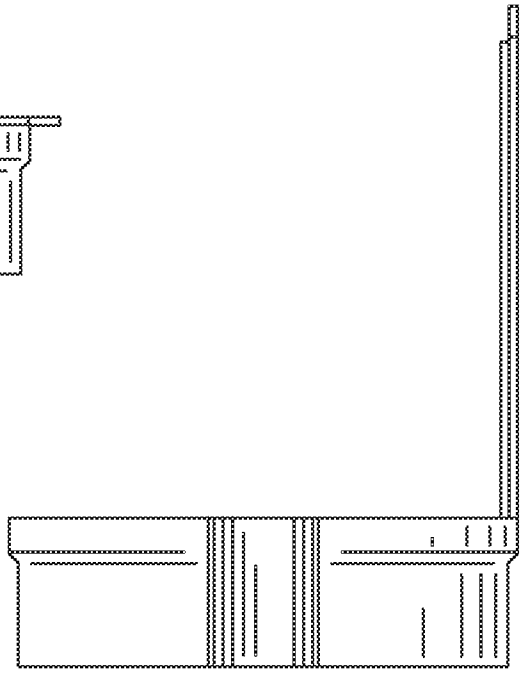
FIG. 31 illustrates a right side view of the cap in FIG. 26.
Figure 30:
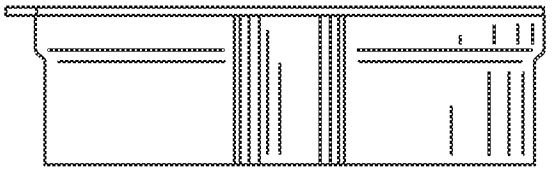
FIG. 30 illustrates a right side view of the cap in FIG. 25.
Figure 33:
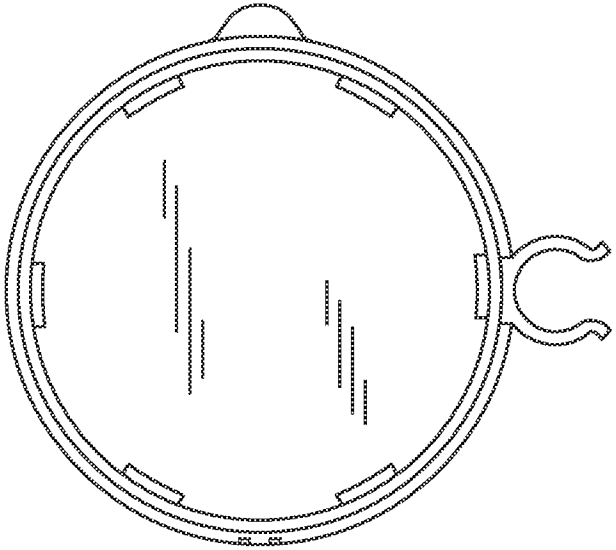
FIG. 33 illustrates a bottom view of the cap in FIG. 25.
Figure 32:
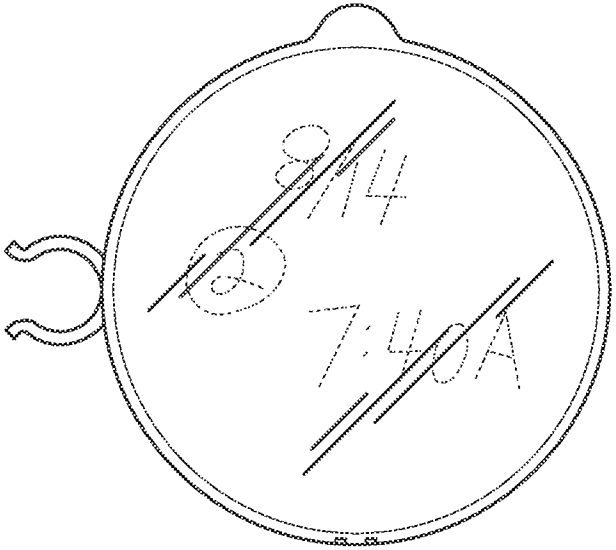
FIG. 32 illustrates a top view of the cap in FIG. 25.
Figure 35:
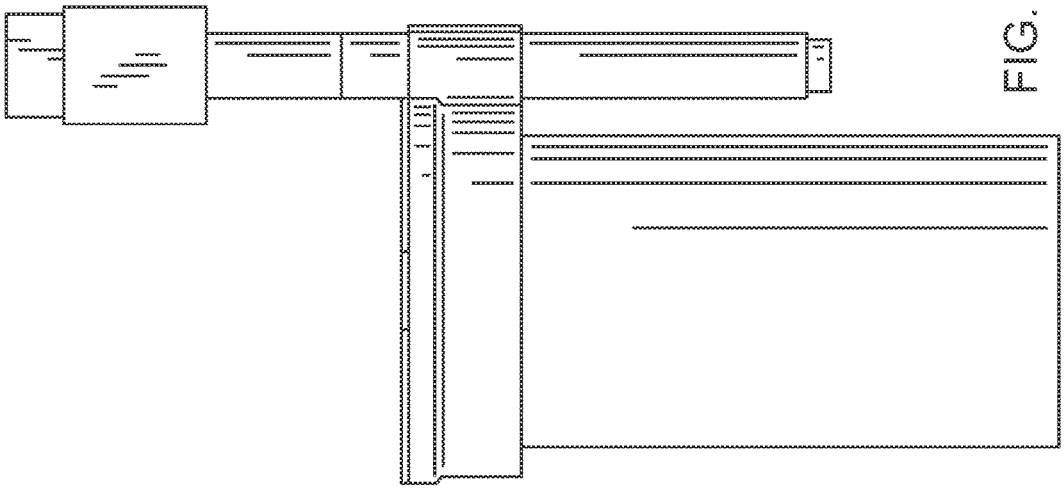
FIG. 35 illustrates a front view of the cap in FIG. 34.
Figure 34:
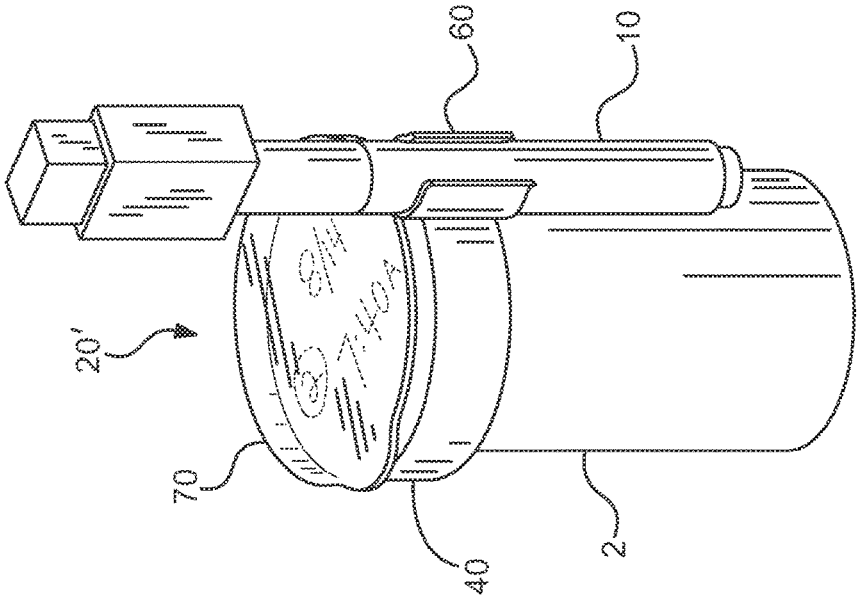
FIG. 34 illustrates another exemplary perspective view of an assembly including a container, a cap with a write-on surface and a writing implement, wherein the cap engages an open end of the container.
Figure 37:
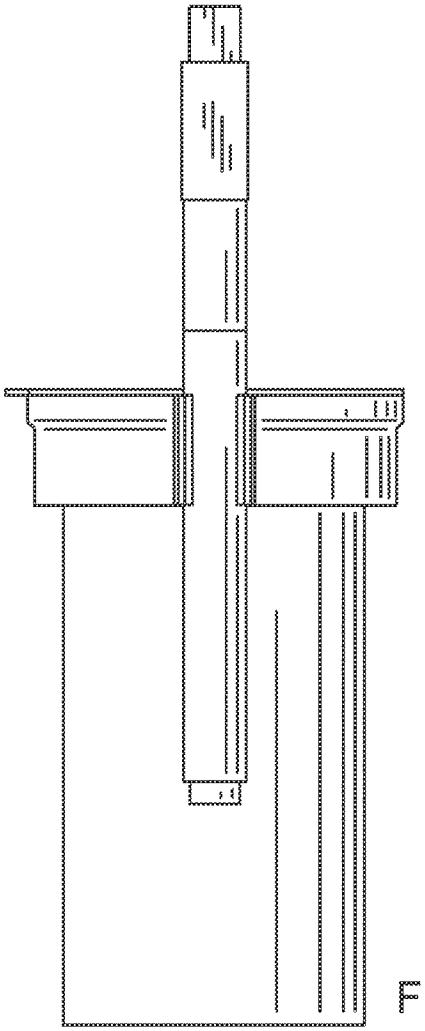
FIG. 37 illustrates a right side view of the cap in FIG. 34.
Figure 36:
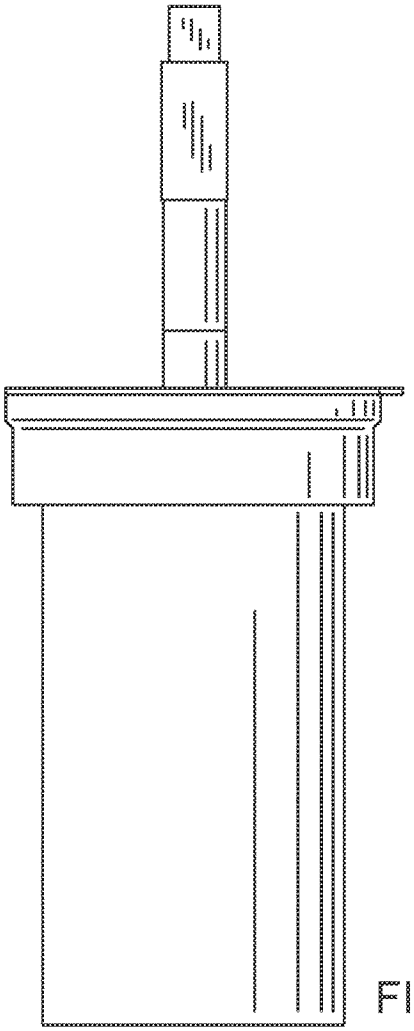
FIG. 36 illustrates a left side view of the cap in FIG. 34.
Figure 39:
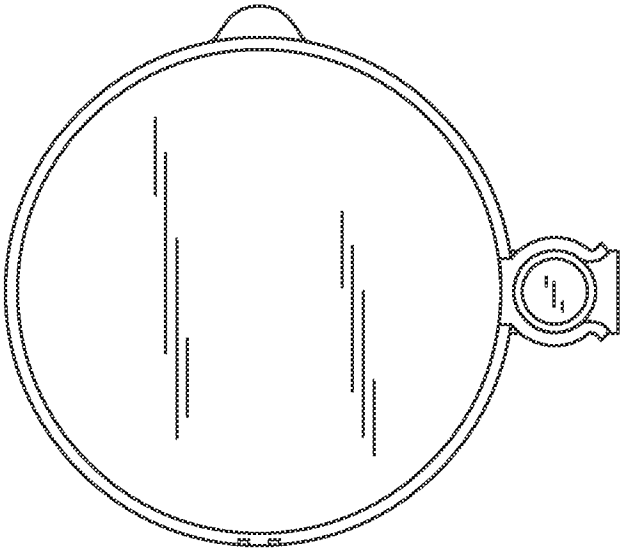
FIG. 39 illustrates a bottom view of the cap in FIG. 34.
Figure 38:
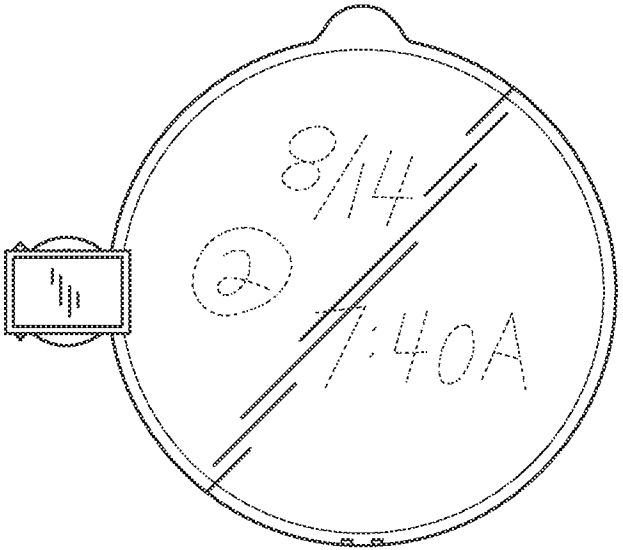
FIG. 38 illustrates a top view of the cap in FIG. 34.

By way of one example only, the engagement 80 is illustrated as tabs or projections 82 on the interior surface 42 of the first peripheral rim 40 mating with lugs 8 on the exterior surface of the container 2 near an open end thereof. Additionally, the cap 20' in this exemplary embodiment may include indicia identifier 17 on the exterior surface 44 of the first peripheral rim 40, as shown in FIG. 14, that is conventional with child resistant (CR) medicine container.

FIGS. 14-20 also illustrate (when presented without reference numerals and further in conjunction with the relevant Brief Description of the Drawings) an ornamental design for a cap with a write-on surface and a writing implement holder. The broken lines representing the container and the writing implement are for environmental purposed only and form no part of the claimed ornamental design. The claimed cap can be used on a medicine container for tracking day, time and/or dose of medicine consumption, where the tracking information is written on the write-on surface.

FIGS. 25-33 illustrate a cap or an article of manufacture 20" which is essentially identical to the cap 20' of FIGS. 14-20, except that the first and second peripheral rims, 40 and 50 respectively, are manufactured or formed from a non-transparent or light-resistant material, while the lid 70 is manufactured or formed from the transparent or light-transmissive material as discussed above.

FIGS. 25-33 also illustrate (when presented without reference numerals and further in a conjunction with the relevant Brief Description of the Drawings) an ornamental design for a cap with a write-on surface and a writing implement holder. The claimed cap can be used on a medicine container for tracking day, time and/or dose of medicine consumption, where the tracking information is written on the write-on surface.

FIGS. 34-39 illustrate an assembly including the container 2 having a closed end, an axially opposite open end and a peripheral surface; the above described cap or article of manufacture 20" including a write-on surface 32, a first peripheral rim 40 adapted for a releaseable coupling to the open end of the container 2, a second peripheral rim 50 upstanding above the write-on surface 32, a clip or holder 60 for releaseably retaining or holding writing implement 10, and the transparent lid 70 selectively movable between the first position, wherein the surface 72 thereof is being generally coplanar with the plane of the write-on surface 32 so as to prevent an access thereto and the second position being disposed at an acute, right or obtuse angle to the plane of the write-on surface 32 so as to allow the access thereto; and the writing implement 10.

FIGS. 34-39 also illustrate (when presented without reference numerals and further in a conjunction with the relevant Brief Description of the Drawings) an ornamental design for an assembly comprising a medicine container, a cap with a write-on surface and a writing implement holder and the writing implement.

FIGS. 40-48 illustrate a cap or an article of manufacture 22 including the previously discussed member 30 with the write-on surface 32, the first peripheral rim 40 and the clip or holder 60 for releaseably retaining or holding writing implement 10. In this exemplary embodiment, a thickness of the member 30, either partially or entirely, extends above the top edge 46 of the first peripheral rim 40. Furthermore, the periphery of the member 30 is smaller than the periphery of the first peripheral rim 40, defining a ledge 34.

A lid 70' is also provided and now includes a second peripheral rim 50', which essentially performs the same function as the above described second peripheral rim 50. The lid 70' is movable between a first position, wherein the surface 72 is being generally coplanar with the plane of the write-on surface 32 so as to prevent access thereto and a second position being disposed at an acute, right or obtuse angle to the plane of the write-on surface 32 so as to allow access thereto. Lid 70' may be manufactured from a transparent or a non-transparent material.

The cap 22 further includes a pivot or a hinge 78 that may be of any construction or type allowing the above described movement of the lid 70'.

FIGS. 40-48 also illustrate (when presented without reference numerals and further in a conjunction with the relevant Brief Description of the Drawings) an ornamental design for a cap with a write-on surface and a writing implement holder. The claimed cap can be used on a medicine container for tracking day, time and/or dose of medicine consumption, where the tracking information is written on the write-on surface.

FIGS. 49-56 illustrate a hollow container or an article of manufacture 140 that includes a channel 150 running along a height or a length thereof and providing a writing implement holder. The channel 150 is sized and shaped so as to releaseably retain the writing implement 10, or any other writing implement, in a manner that provides for ease of insertion and removal thereof and also prevents unintentional movement or dislodgement of the writing implement 10 from the channel 150. The channel 150 may have an opening 152 in an open communication with an exterior surface 142 of the container 140 or may be provided as a bore or a cavity within the wall thickness of the container 140. Also shown in the exemplary embodiment of FIGS. 50-54, are the above described lugs 8 adjacent an open end 144 of the container 140.

A write-on surface 32' with or without the base or substrate 34 may be provided on the exterior surface 142 of the container 140.

The exemplary container 140 is illustrated as being manufactured from a non-transparent material, although the transparent material is also contemplated in this document.

Container 140 may be also used in a combination with a cap, for example constructed identical to the cap of FIG. 1, but without the holder 60.

FIGS. 49-56 also illustrate (when presented without reference numerals and further in a conjunction with the relevant Brief Description of the Drawings) an ornamental design for a container with a write-on surface and a writing implement holder.

FIGS. 57-64 illustrate a container or an article of manufacture 160 comprising a closed end 166, an axially open end 168, and a peripheral wall defining a height or a length of the container 160 and a hollow interior 164 thereof. The container 160 further comprises an elongated pocket 170 disposed along and aligned with a portion of the peripheral wall 162 or being inclined at an angle thereto. The pocket 170 provides a writing implement holder. The pocket 170 may be disposed within the hollow interior of the container 160 or may protrude beyond the exterior surface 162 thereof. The container 160 may further include an opening 172 disposed at the closed end 168 of the container 160 in an open communication with the pocket 170. A closed end 174 of the pocket 170 may be shaped and sized to define a cap for the writing implement 10' that may be also provided with an eraser portion 16'.

The exemplary container 160 is illustrated as being manufactured from a transparent, light-transmissive material, although the non-transparent, light resistant material is also contemplated in this document. The exemplary container 160 is further illustrated as being usable in a combination with any one of the above described caps 20, 20', 20" and 22.

FIGS. 57-64 also illustrate (when presented without reference numerals and further in a conjunction with the relevant Brief Description of the Drawings) an ornamental design for a container with a write-on surface and a writing implement holder.

FIGS. 65-74 illustrate a cap or an article of manufacture 24 having a member 30' with the write-on surface 32 and with a second peripheral rim 50 forming a cavity in an opposing surface 33 and being sufficiently flexible so as to provide a snap-on engagement with an open top of a hollow container having an open end. Accordingly, the member 30' may be adapted with a pull tab 37 that can be identical to the above described pull tab 74. The above described second peripheral rim 50 and the lid 70 may be also provided.

FIGS. 65-74 also illustrate (when presented without reference numerals and further in a conjunction with the relevant Brief Description of the Drawings) an ornamental design for a cap with a write-on surface. The claimed cap can be used on a medicine container for tracking day, time and/or dose of medicine consumption, where the tracking information is written on the write-on surface.

The cap 24 may be provided without the lid 70 and even without the second peripheral rim 50. Furthermore, the cavity 84 may be replaced with the adhesive 38 or any other suitable fastener, for example such as a hook and loop fastener.

FIGS. 75-80 illustrate a container 180 comprising a closed end, axially open end, and a peripheral wall defining a height of the container 180 and a hollow interior 184 thereof. The container 180 further comprises an abutment 188 on an exterior surface 182 thereof disposed along and aligned with a portion of the peripheral wall or inclined at an angle thereto. An elongated pocket 190 is provided within the abutment 188 and has an open end 192 thereof disposed adjacent an open end 184 of the container 180. The pocket 190 provides a writing implement holder. A closed end 194 of the pocket 190 may be shaped and sized to define a cap for the writing implement (not shown). It is also contemplated that the orientation of the pocket 190 may be reversed with the open end 192 thereof being positioned adjacent a closed end 188 of the container 180.

FIGS. 75-80 also illustrate (when presented without reference numerals and further in a conjunction with the relevant Brief Description of the Drawings) an ornamental design for a container with a writing implement holder.

FIGS. 81-85 illustrate a cap or an article of manufacture 26 constructed essentially the same as a non-child resistant cap currently used at CVS pharmacies and further comprising the above described write-on surface 32 and writing implement holder 60.

FIGS. 81-85 also illustrate (when presented without reference numerals and further in a conjunction with the relevant Brief Description of the Drawings) an ornamental design for a cap with a write-on surface and a writing implement holder. The claimed cap can be used on a medicine container for tracking day, time and/or dose of medicine consumption, where the tracking information is written on the write-on surface.

The caps of exemplary embodiments of FIGS. 1-48 and 81-85 may be provided in either a child-resistant or a child-nonresistant form. When the caps of the exemplary embodiments of FIGS. 1-48 and 81-85 are provided in the child-resistant or a safety form, at least the interior of the first peripheral rim 40 may be provided in accordance with teachings of the U.S. Pat. No. 5,938,055 issued to Philips et al. on Aug. 17, 1999 or teachings of the U.S. Pat. No. 5,449,078 issued to Akers on Sep. 12, 1995, both incorporated by reference thereto in this document.

FIGS. 86-91 illustrate an exemplary cap or an article of manufacture 28 constructed essentially the same as the cap currently used at Walgreens pharmacies and being of a dual use in locking (child-resistant) or non-locking modes. The exemplary cap 28 may be adapted with a pair of write-on surfaces 32 so that the user can record needed information irregardless of whether the cap 28 is used in locking or non-locking modes. The exemplary cap 28 further includes the above described implement holder 60. In the exemplary cap 28, the engagement 80 is provided as an internal thread 86.

FIGS. 86-91 also illustrate (when presented without reference numerals and further in a conjunction with the relevant Brief Description of the Drawings) an ornamental design for a cap with a write-on surface and a writing implement holder. The claimed cap can be used on a medicine container for tracking day, time and/or dose of medicine consumption, where the tracking information is written on the write-on surface.

Figure 93:
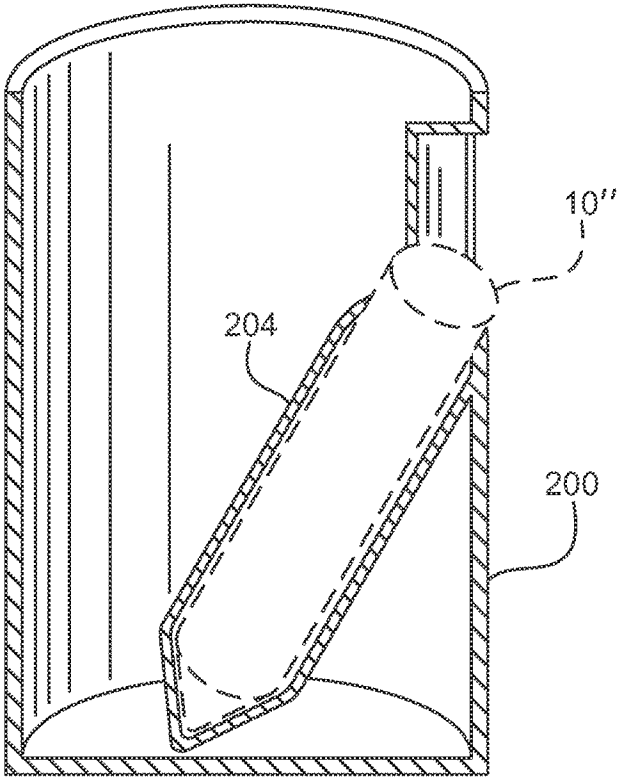
FIG. 93 illustrates an environmental view of the container of FIG. 92.
Figure 92:
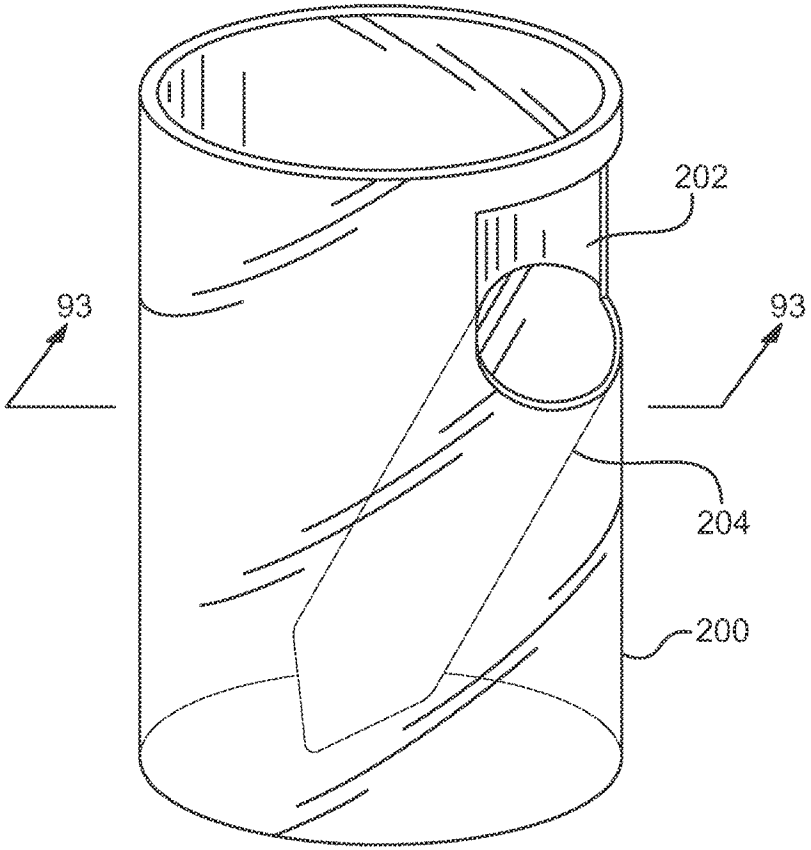
FIG. 92 illustrates an exemplary container with a pocket being inclined at an angle relative to a peripheral wall of the container for releaseably retaining a writing implement.

Now in reference to FIGS. 92 and 93, an exemplary container 200 includes a pocket 204 that may be identical to the above described pocket 170, except as being inclined relative to the peripheral wall of the container 200 and provide in an open communication with a cut-out 202 in the container 200. The pocket 204 provides a writing implement holder for the writing implement 10".

Figure 94:
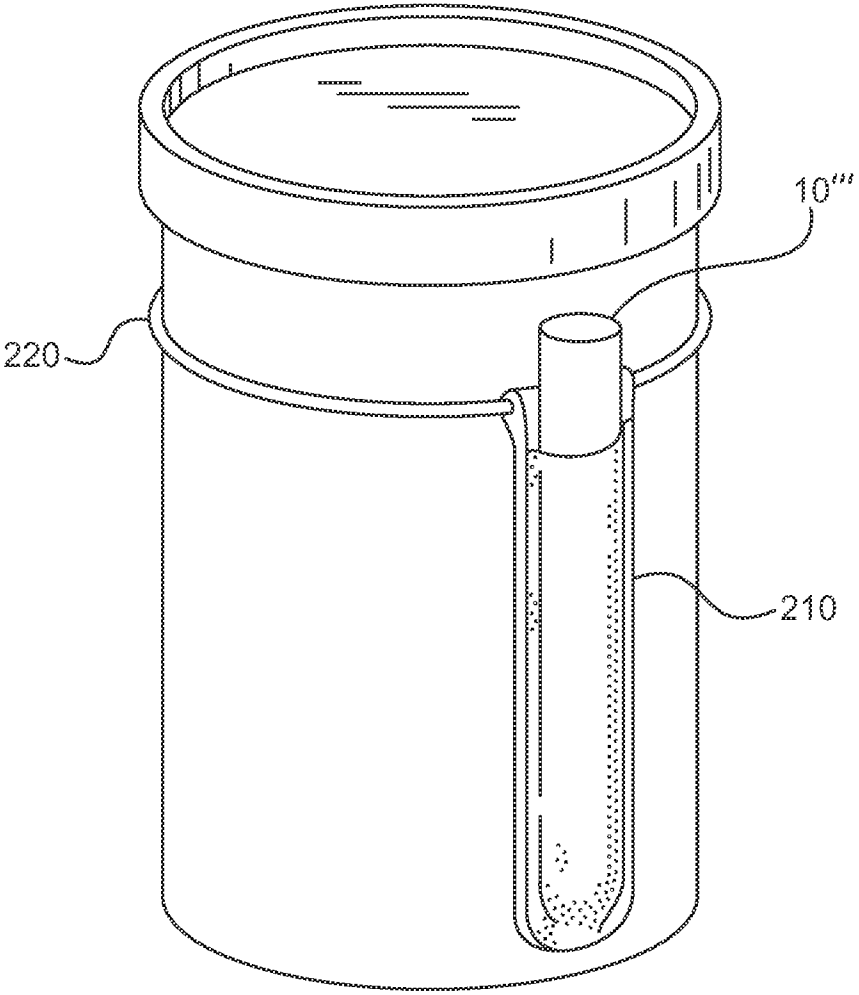
FIG. 94 illustrates an article of manufacture configured to receive a writing implement therewithin and is further configured to be attach onto a surface of a container.

FIG. 94 illustrates an exemplary article of manufacture, such as a hollow device 210, that may be manufactured from a flexible or rigid material and that is configured to receive a writing implement 10''' therewithin. The device 210 essentially provides a pouch or a pocket and is further configured to attach onto an exterior surface of a container for example, with an elastic and resilient strap or band 220. Although illustrated in FIG. 94 as being attached onto the exterior surface of the container, the article of manufacture 210 may be attached to the exterior surface of any of the above described cap and replace the writing implement holder 60.

Figure 97:
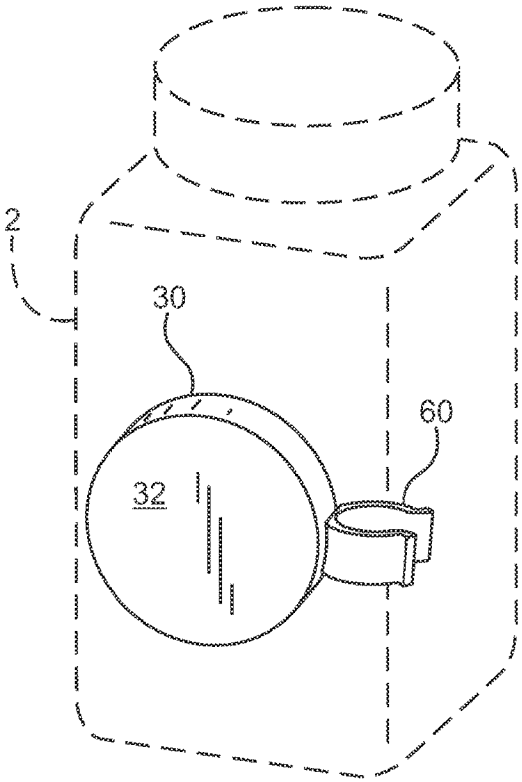
FIG. 97 illustrates an elevation view of an article of manufacture with a write-on surface and a writing implement holder configured for attachment onto a peripheral surface of a container.
Figure 95:
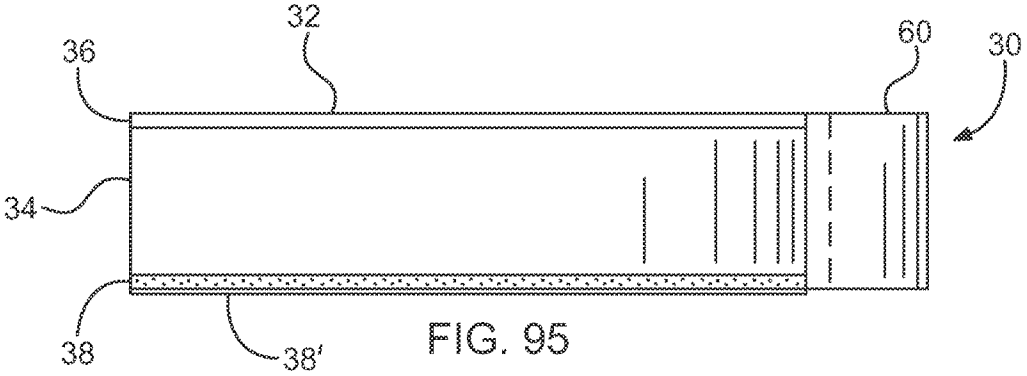
FIG. 95 illustrates an exemplary elevation view of an article of manufacture with a write-on surface and a writing implement holder configured for attachment onto a terminal end surface of a cap.
Figure 96:
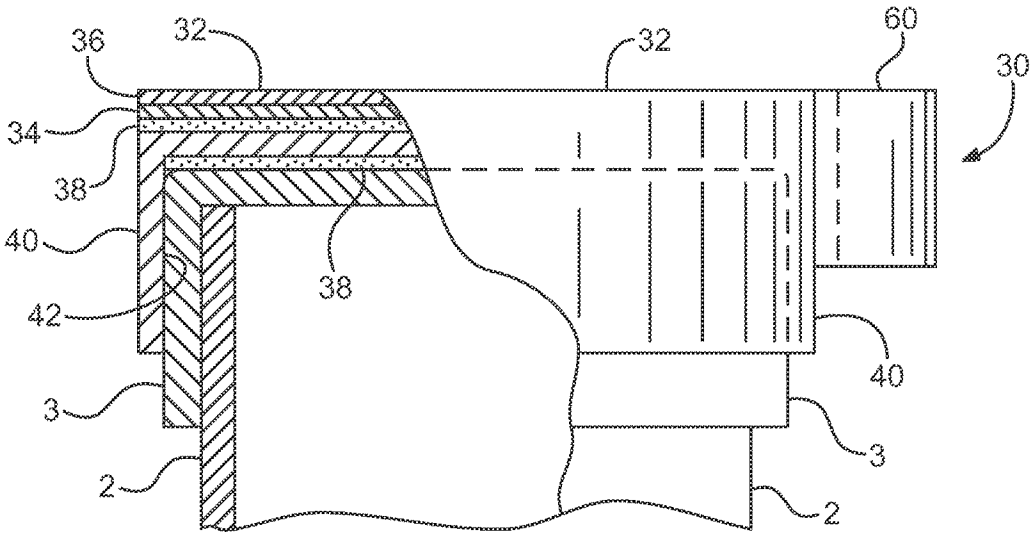
FIG. 96 illustrates another exemplary elevation view of an article of manufacture with a write-on surface and a writing implement holder configured for attachment onto a terminal end surface of a cap.

Now in a reference to further exemplary embodiments of FIGS. 95-97, therein is illustrated an article of manufacture comprising the above described member 30 with the adhesive 38 disposed on a surface of the substrate 34 being opposite the write-on surface 32 so as to be attached, either permanently or temporarily onto a terminal end surface of an existing cap used with the container 2, in a reference to FIG. 95 or onto the exterior surface 6 of the container 2, in a reference to FIG. 97. Such adhesive 38 defines another exemplary form of the engagement 80. At least a portion of the member 30 in the example of FIG. 97 may be curved to fit the shape of the exterior surface 6. A peelable cover 38' may be also provided. The peelable cover 38' may be made hollow to envelop an entire periphery of the member 30. The adhesive 38 may be replaced with a loop and hook fastener and the like fasteners in this and other exemplary embodiments. The writing implement holder 60 may be also provided. It is further contemplated that the member 30 in FIG. 96 may be adapted at least with the above described first peripheral rim 40 so as to be attached onto the existing cap 3 with the engagement 80 being defined either by the adhesive 38 or equivalent, by a friction fit engagement between the interior surface 42 of the first peripheral rim 40 and the exterior surface of the cap 3 already in use or by any other fasteners, for example such as hook and loop fastener. In this exemplary embodiment, the member 30 indirectly covers the open end of the container. The adhesive 38 may be only provided on the interior surface 42 of the first peripheral rim 40 or may be provide in a combination with the adhesive 38 on the interior surface of the substrate 34. The adhesive 38 on the interior surface 42 of the first peripheral rim 40 may be replaced, either entirely or in segments, with one half of a hook and loop fastener, for example such as Velcro®, with the mating half being complementary disposed on the exterior surface of the cap 3. The second peripheral rim 50 and/or the lid 70 may be also provided with the member of FIGS. 95-96. Thus, it is also contemplated in another exemplary embodiment that the engagement 80 may also include the first peripheral rim 40.

In yet a further exemplary embodiment, the adhesive 38 with or without the peelable cover 38' may be provided on the bottom surface of the cap 24 of FIGS. 65-74 that can be further provided without the lid 70 and even without the second peripheral rim 50.

In operation, when using the exemplary embodiments of FIGS. 1-48, 65-74, 81-91 and 95-97 in a combination with a medicine container, the user, tasked with taking prescription and/or non-prescription medicine and/or supplements or a caregiver tasked to assist with taking or administering such medicine and/or supplements, can easily record by marking/writing, with the writing implement 10, the date, time and/or quantity of the next dose (Next Dose Due) immediately upon current dose (Last Dose Taken) being disposed of. The user or caregiver may alternatively record the date, time and/or quantity of the dose (Last Dose Taken) just taken. The user or caregiver may also record the name of the medicine particularly where the letters are sized larger than those on the medicine container label (not shown).

The exemplary embodiments of FIGS. 1-48, 65-74, 81-91 illustrate a cap that directly covers an open end of the container.

The user or caregiver can easily review the information on any of the above write-on surfaces to determine if a subsequent dose of medicine or a supplement may or should be administered. If determined that the user or caregiver may or should administer a subsequent dose, the user or caregiver first erases all the information on the writing surface with any one of a hand, a cloth, or a compatible eraser, particularly when provided on the writing implement. Immediately or with some time gap, after administering the medicine or supplement, the user or caregiver writes the current time and date and/or amount on the write-on surface with the writing implement. For example, if medicine was taken at 10:10 am, then the user or caregiver writes "10:10 am" and includes the current date. The amount or required dosage (as in the case of varying amounts of liquid fever reducers given to infants and children by weight) may also be recorded.

When the user or caregiver prefers to update Next Dose Due information, he or she will write and/or update the appropriate time, day and/or dosage. The information on the write-on surface may be easily and conveniently reviewed at any time, particularly when the lid 70 is manufactured from the transparent or light-transmissive material.

Thus, the method of tracking at least one of date, time, consumption and/or usage dosage or quantity, and description of contents in a container includes the steps of providing an article of manufacture with a write-on surface, with or without the writing implement holder and with or without the lid, attaching the article of manufacture either onto an open end of a container or onto a cap covering such open end of the container by any of the above described engagement 80, and using a writing implement, provided either with the article of manufacture or separately therefrom to repetitively and selectively write and erase the at least one of date, time, consumption and/or usage dosage or quantity, and description of contents on the write-on surface. The method may also comprise the step of providing a lid and selectively opening the lid to gain access to the write-on surface and closing the lid to prevent such access to the write-on surface.

It is contemplated that a portion of the indicia identifier 19 reflecting such terms as "Next Dose Due", "Last Dose Taken", "am", "pm", "Date", "amount", "dosage" may be preprinted or molded on the write-on surface 32 so as to reduce the writing effort.

Figure 41:
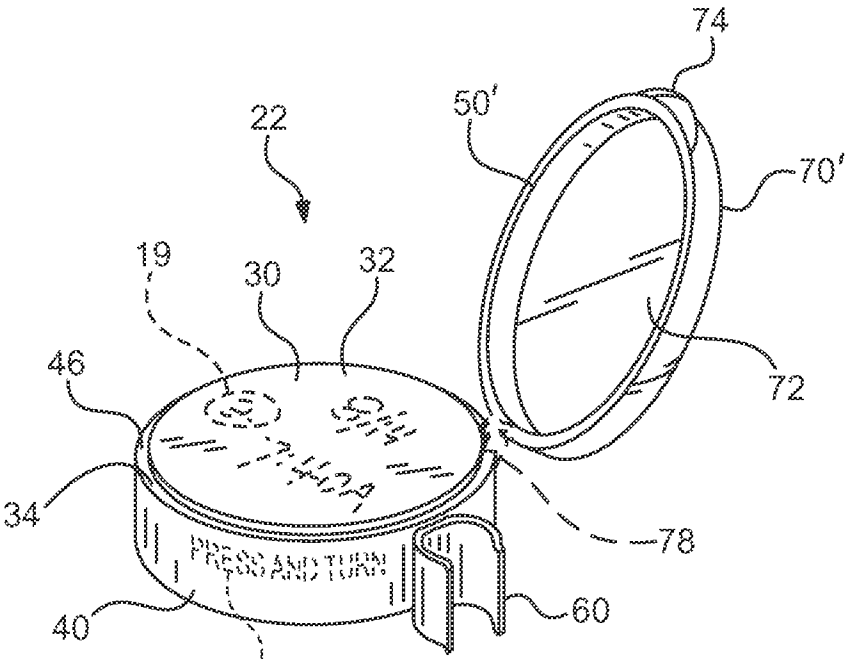
FIG. 41 illustrates another perspective view of the cap of FIG. 40 with a protective lid in an open position.
Figure 40:
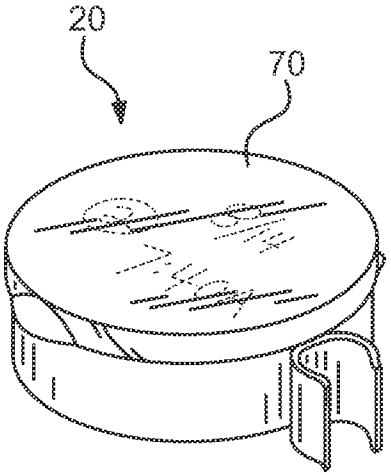
FIG. 40 illustrates a further exemplary perspective view of a cap with a write-on surface and a writing implement holder.
Figure 43:
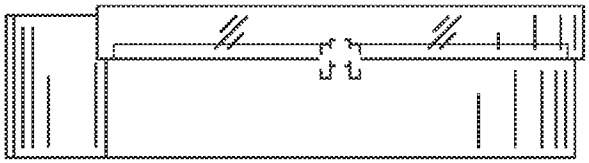
FIG. 43 illustrates a rear view of the cap in FIG. 40.
Figure 44:
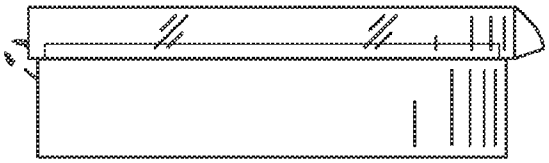
FIG. 44 illustrates a left side view of the cap in FIG. 40.
Figure 42:
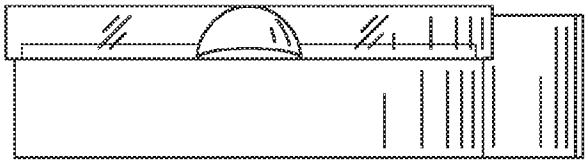
FIG. 42 illustrates a front view of the cap in FIG. 40.
Figure 46:
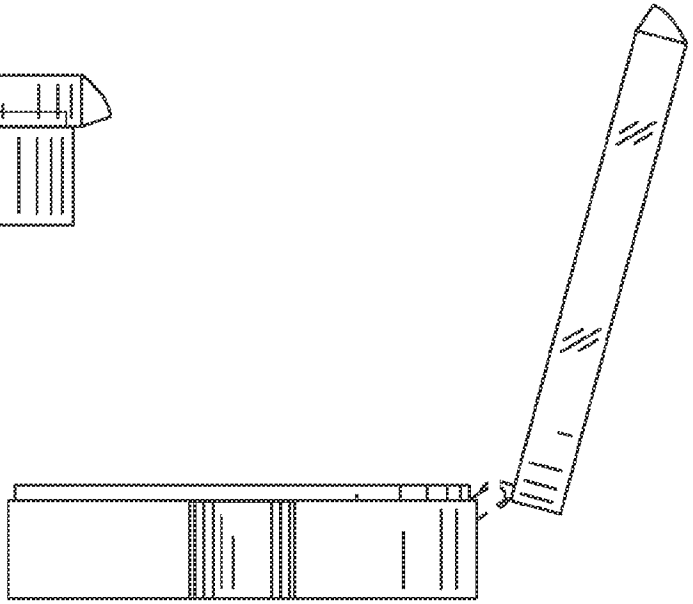
FIG. 46 illustrates a right side view of the cap in FIG. 41.
Figure 45:
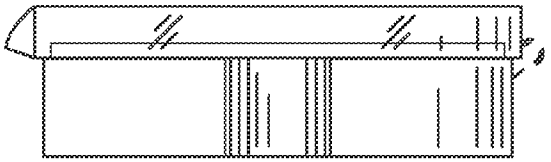
FIG. 45 illustrates a right side view of the cap in FIG. 40.
Figure 48:
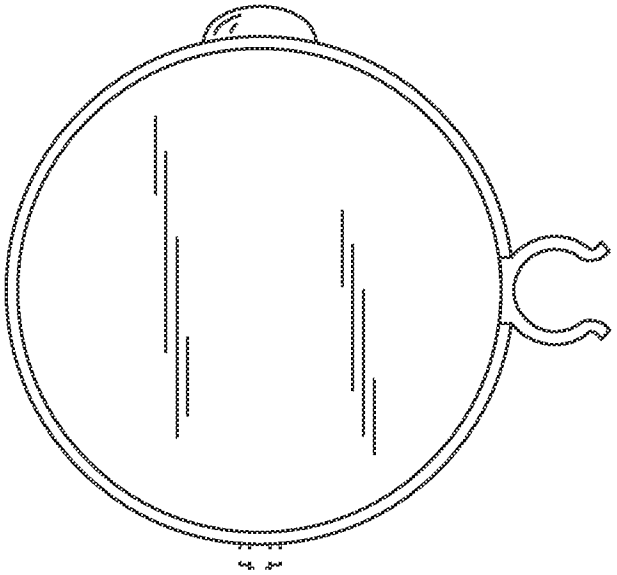
FIG. 48 illustrates a bottom view of the cap in FIG. 40.
Figure 47:
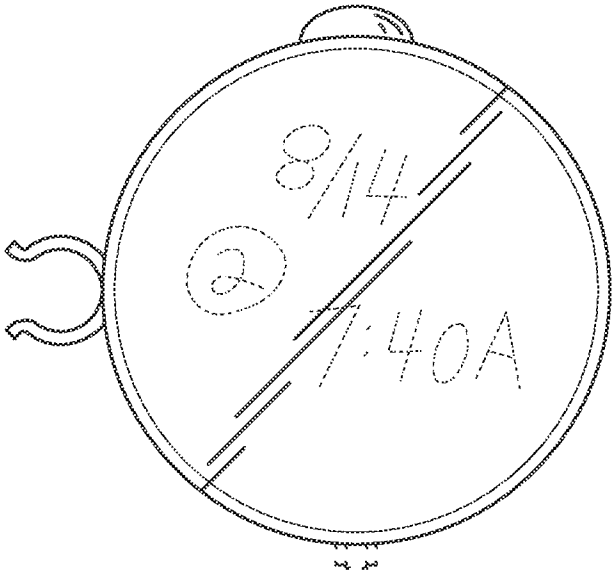
FIG. 47 illustrates a top view of the cap in FIG. 40.
Figure 50:
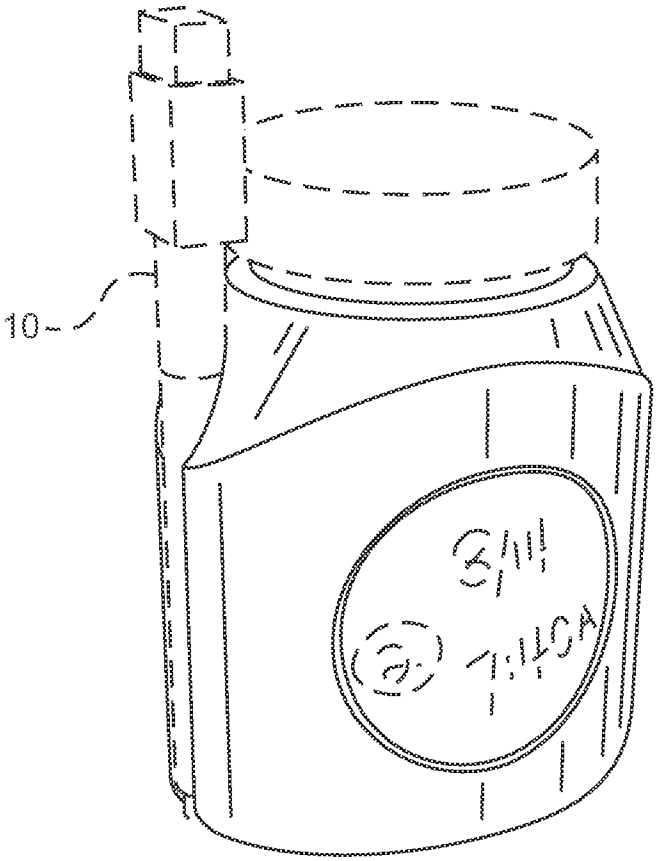
FIG. 50 illustrates a perspective environmental view of the container of FIG. 49 in a combination with a cap and a writing implement, both shown in broken lines.
Figure 49:
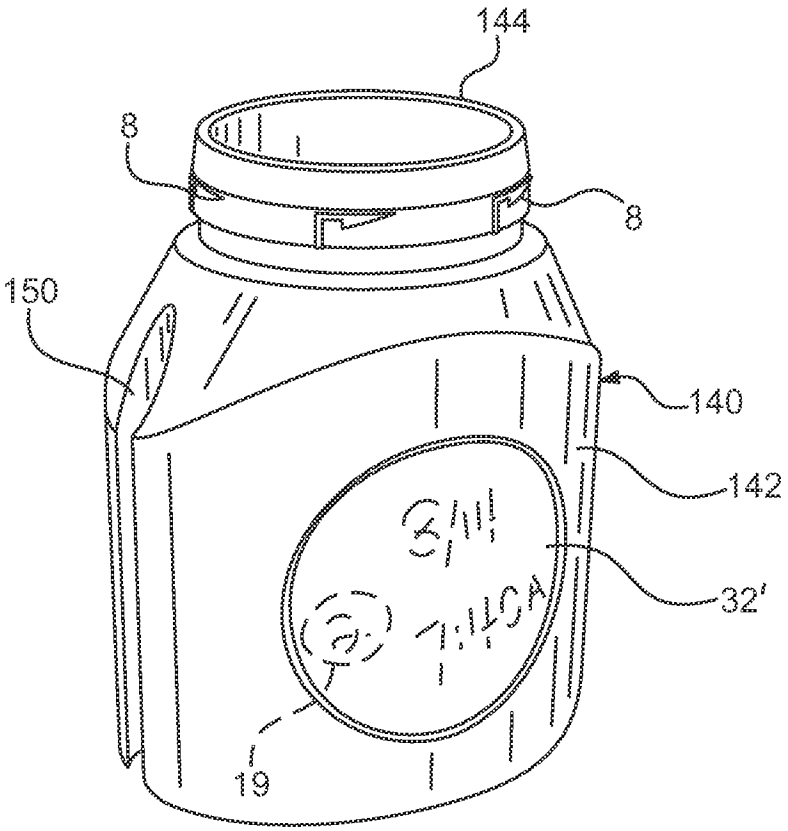
FIG. 49 illustrates an exemplary perspective view of a container configured for releaseably retaining a writing implement.
Figure 52:
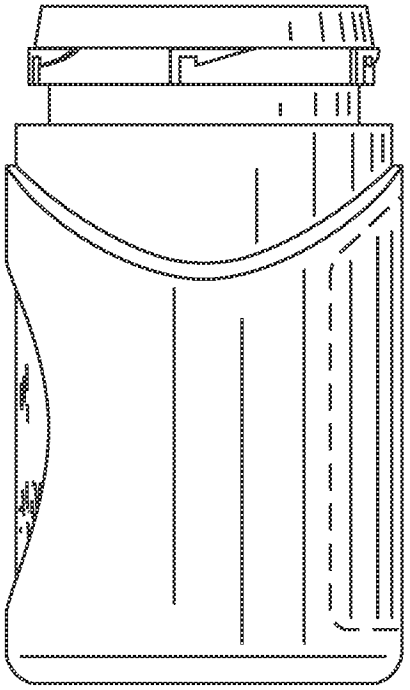
FIG. 52 illustrates a left side view of the container in FIG. 49.
Figure 51:
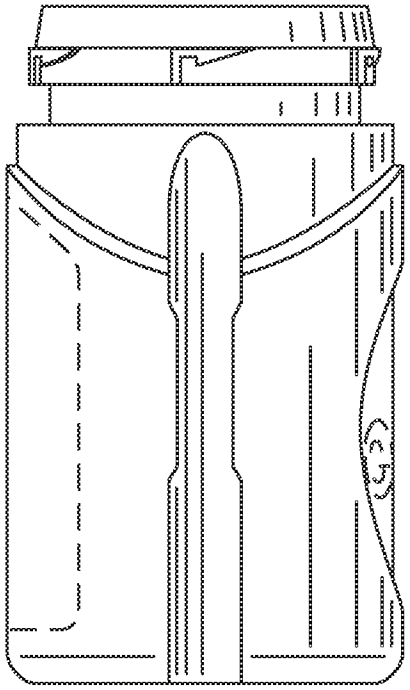
FIG. 51 illustrates a right side view of the container in FIG. 49.
Figure 54:
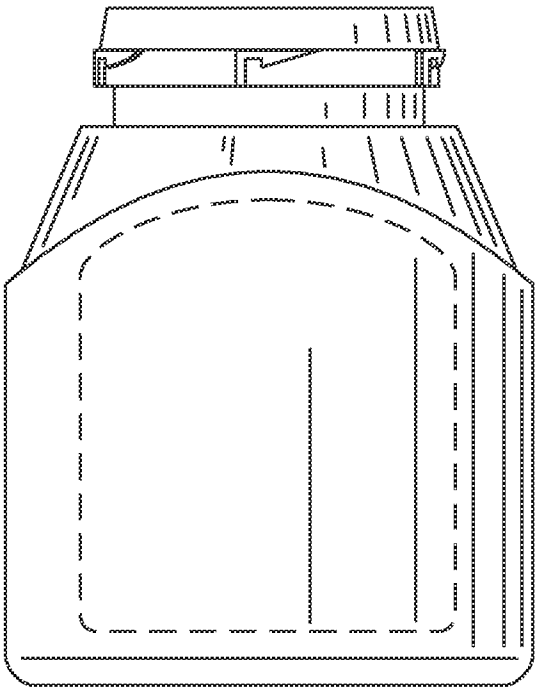
FIG. 54 illustrates a rear view of the container in FIG. 49.
Figure 53:
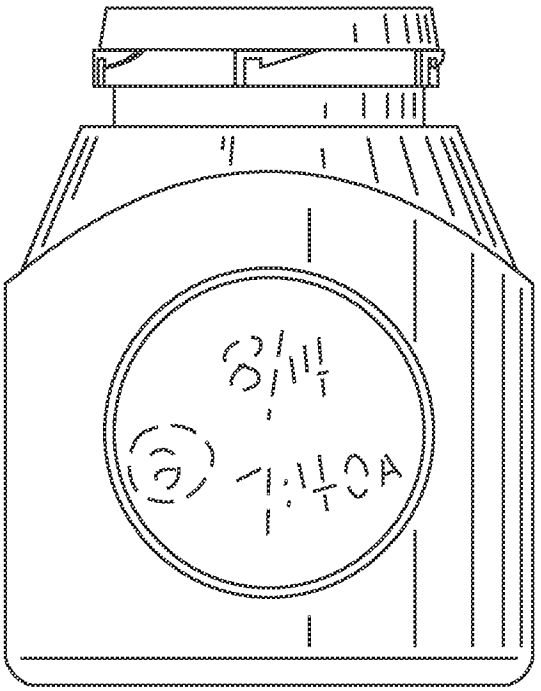
FIG. 53 illustrates a front view of the container in FIG. 49.
Figure 56:
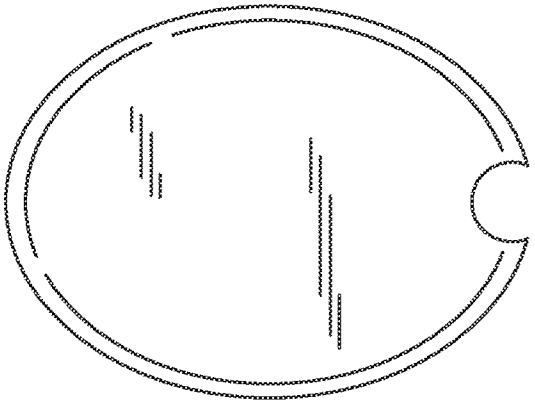
FIG. 56 illustrates a bottom view of the container in FIG. 49.
Figure 55:
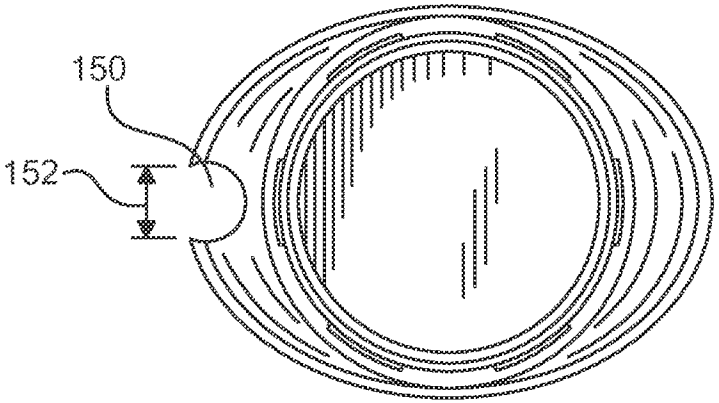
FIG. 55 illustrates a top view of the container in FIG. 49.
Figure 59:
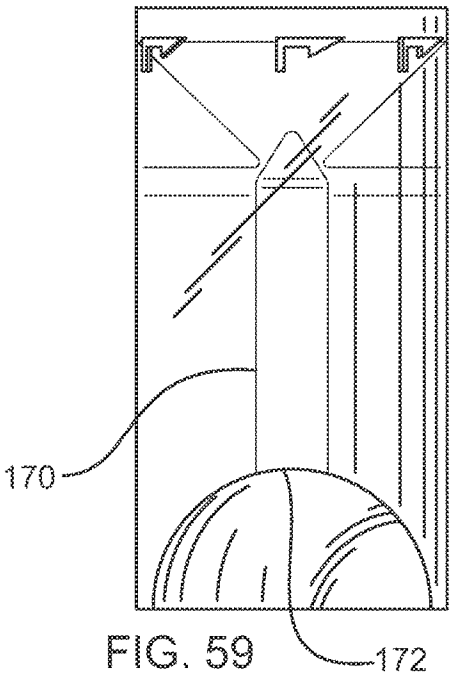
FIG. 59 illustrates a front view of the container in FIG. 57.
Figure 58:
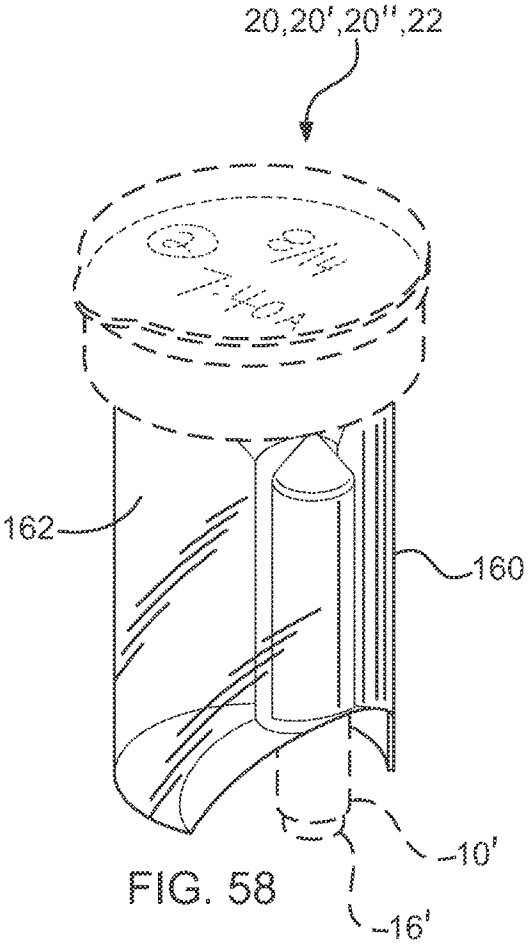
FIG. 58 illustrates a perspective environmental view of the container of FIG. 59 in a combination with a cap and a writing implement, both shown in broken lines.
Figure 57:
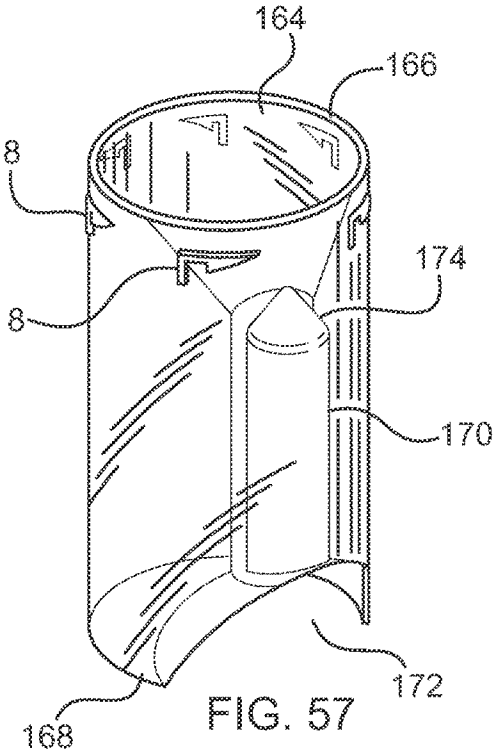
FIG. 57 illustrates another exemplary perspective view of a container configured for releaseably retaining a writing implement.
Figure 61:
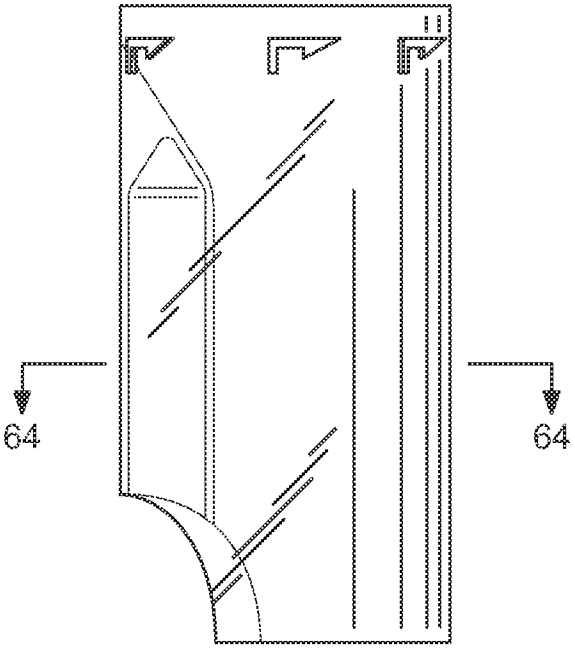
FIG. 61 illustrates a left side view of the container in FIG. 57.
Figure 60:
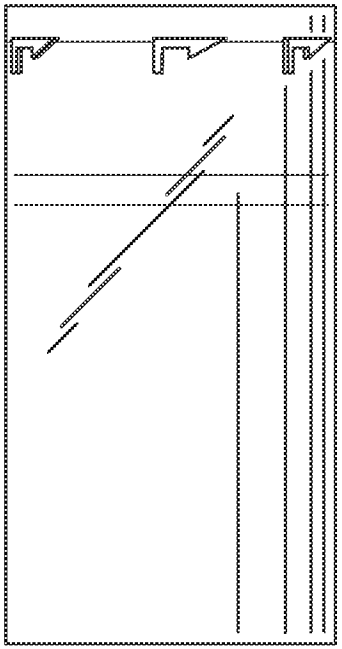
FIG. 60 illustrates a rear view of the container in FIG. 57.
Figure 64:
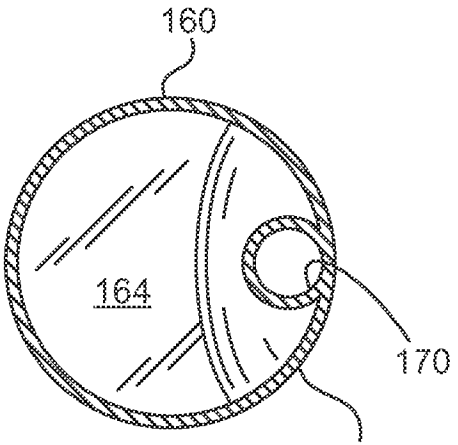
FIG. 64 illustrates a cross-sectional view of the container in FIG. 57.
Figure 63:
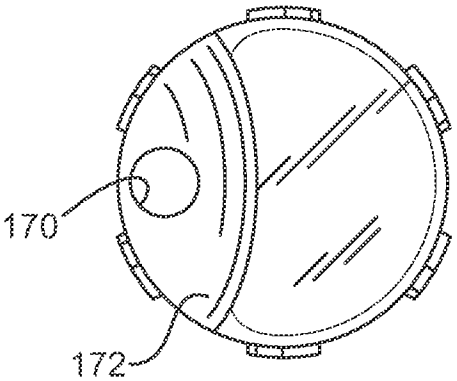
FIG. 63 illustrates a bottom view of the container in FIG. 57.
Figure 62:
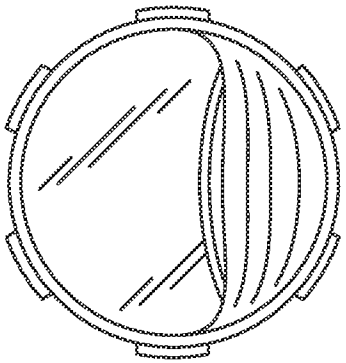
FIG. 62 illustrates a top view of the container in FIG. 57.
Figure 66:
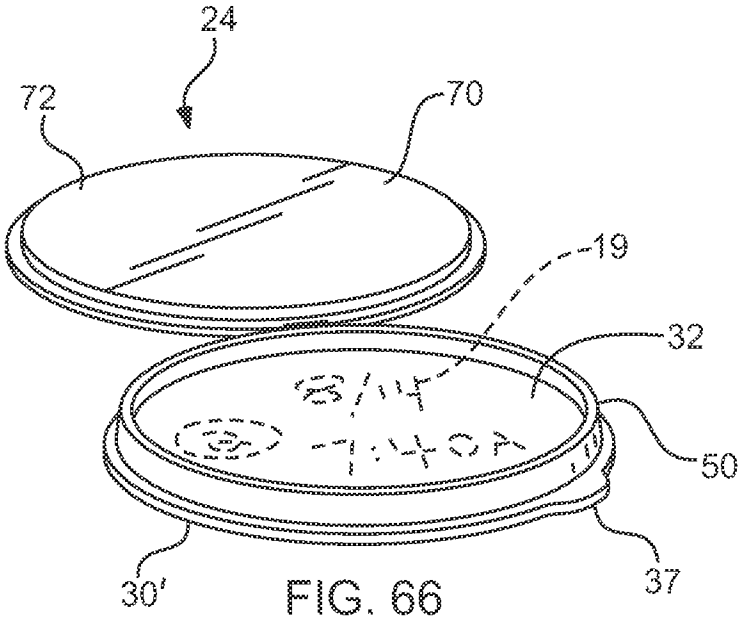
FIG. 66 illustrates another perspective view of the cap of FIG. 65 with a protective lid in an open position.
Figure 65:
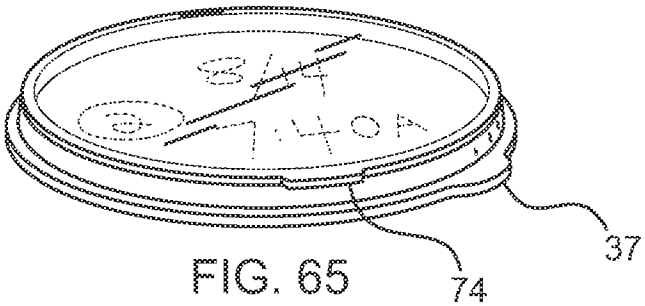
FIG. 65 illustrates yet a further perspective view of a cap with a write-on surface.
Figure 68:
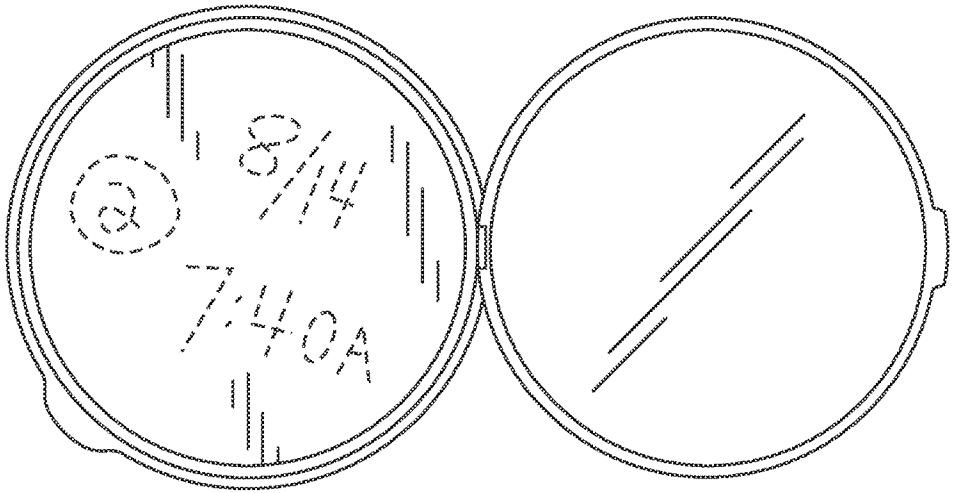
FIG. 68 illustrates a top view of the cap in FIG. 66.
Figure 67:
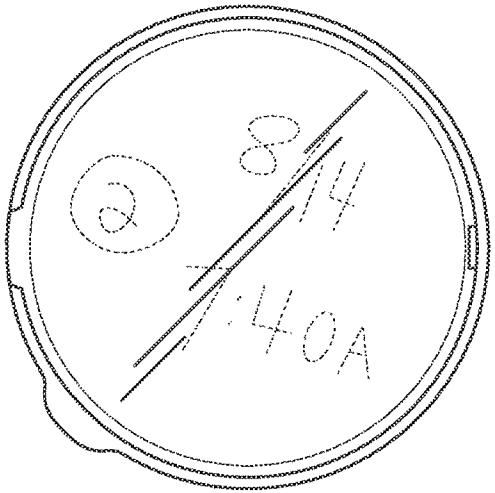
FIG. 67 illustrates a top view of the cap in FIG. 65.
Figure 69:
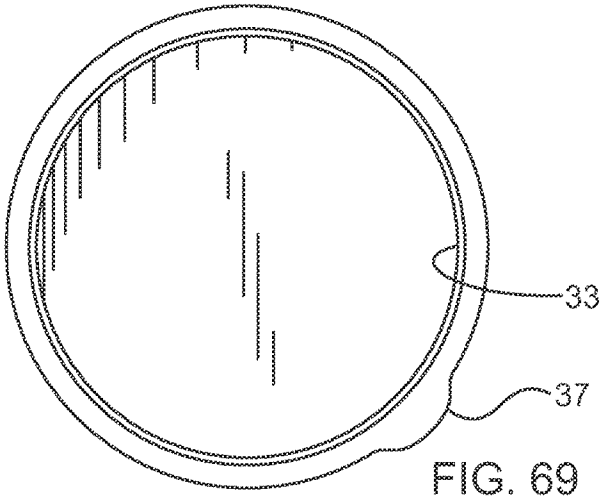
FIG. 69 illustrates a bottom view of the cap in FIG. 65.
Figure 71:
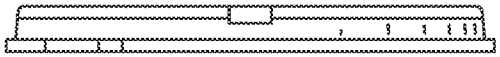
FIG. 71 illustrates a right view of the cap in FIG. 65.
Figure 72:
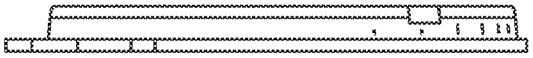
FIG. 72 illustrates a left side view of the cap in FIG. 65.
Figure 74:
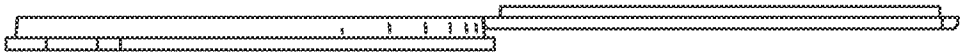
FIG. 74 illustrates a right side view of the cap in FIG. 68.
Figure 70:
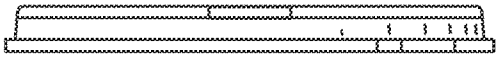
FIG. 70 illustrates a front view of the cap in FIG. 65.
Figure 73:
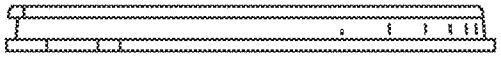
FIG. 73 illustrates a rear view of the cap in FIG. 65.
Figure 76:
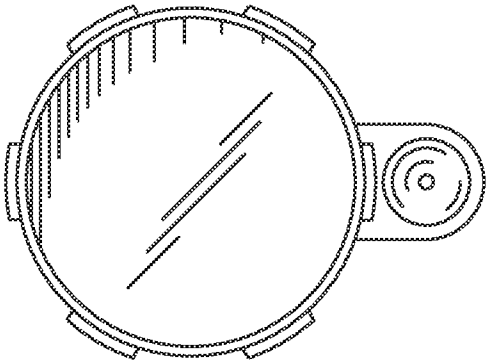
FIG. 76 illustrates a top view of the container in FIG. 75.
Figure 77:
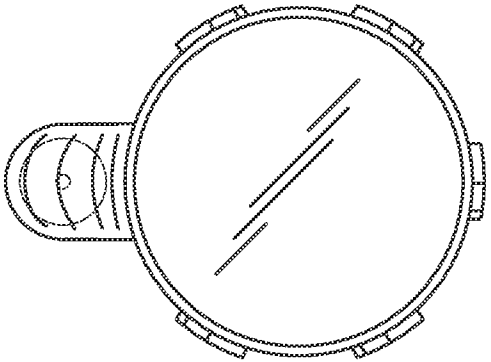
FIG. 77 illustrates a bottom view of the container in FIG. 75.
Figure 75:
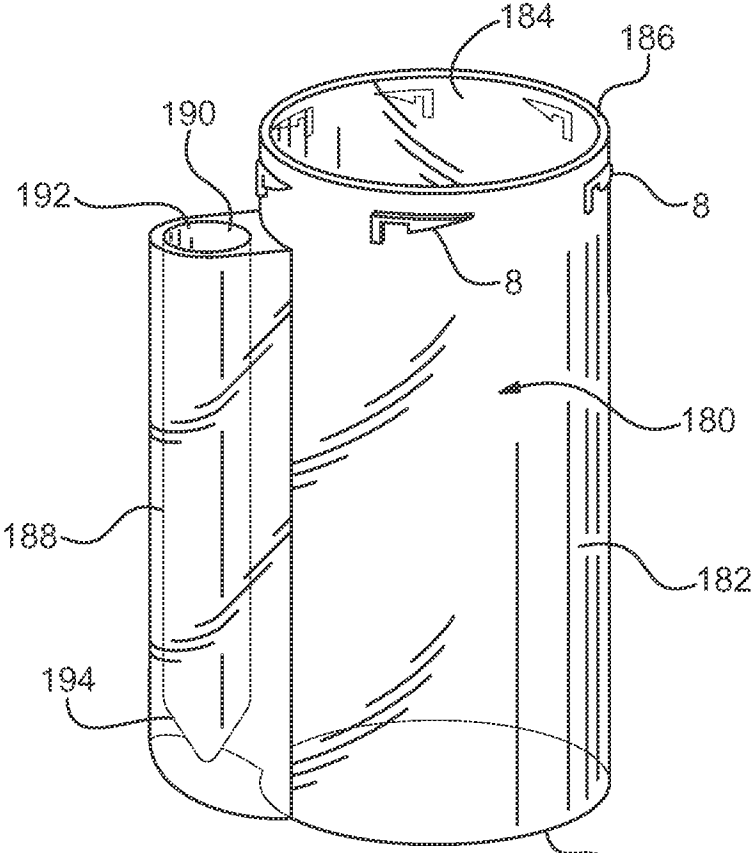
FIG. 75 illustrates another exemplary perspective view of a container configured for releaseably retaining a writing implement.
Figure 80:
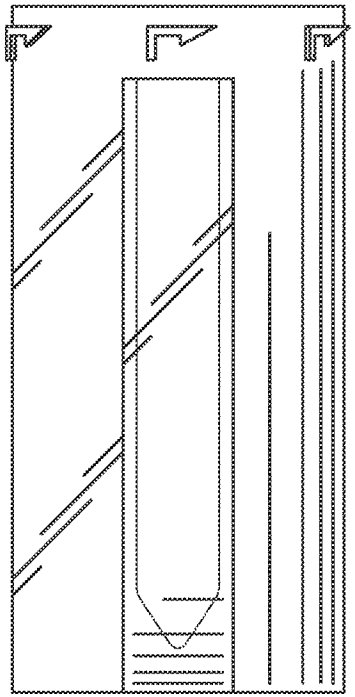
FIG. 80 illustrates a right view of the container in FIG. 75.
Figure 79:
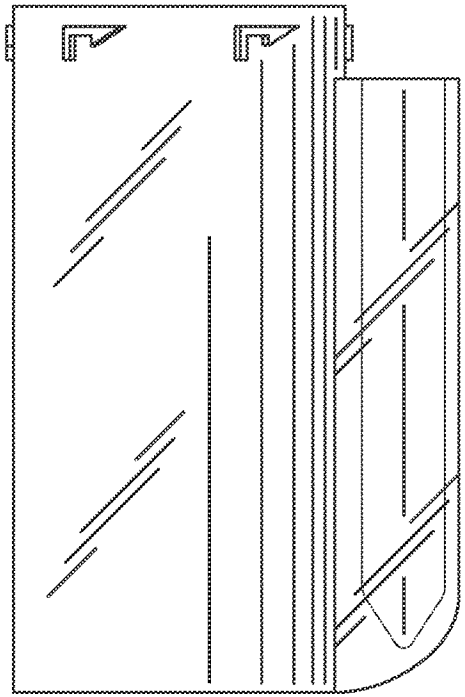
FIG. 79 illustrates a rear view of the container in FIG. 75.
Figure 78:
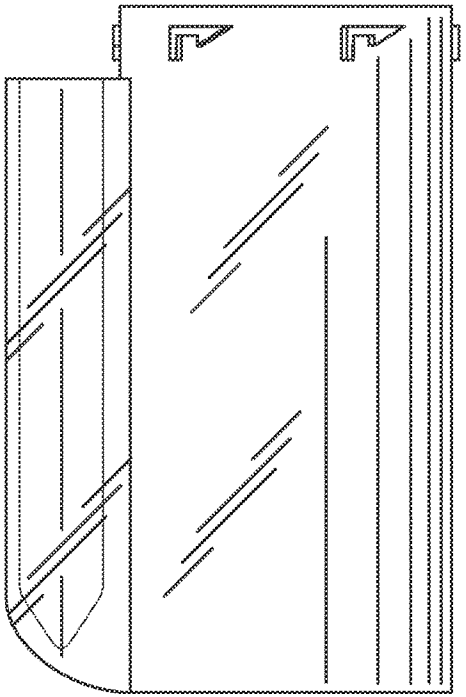
FIG. 78 illustrates a front view of the container in FIG. 75.
Figure 83:
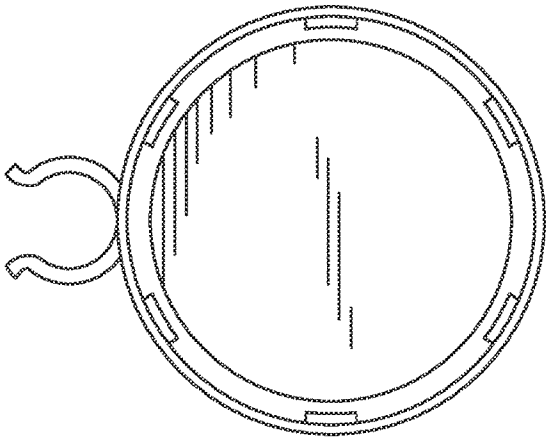
FIG. 83 illustrates a bottom view of the cap in FIG. 81.
Figure 84:
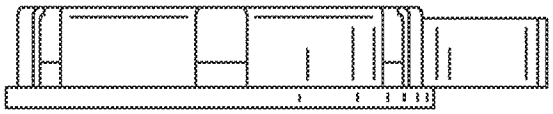
FIG. 84 illustrates a front view of the cap in FIG. 81.
Figure 85:
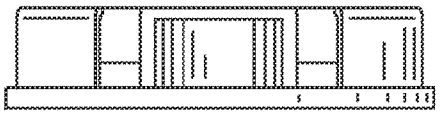
FIG. 85 illustrates a right view of the cap in FIG. 81.
Figure 81:
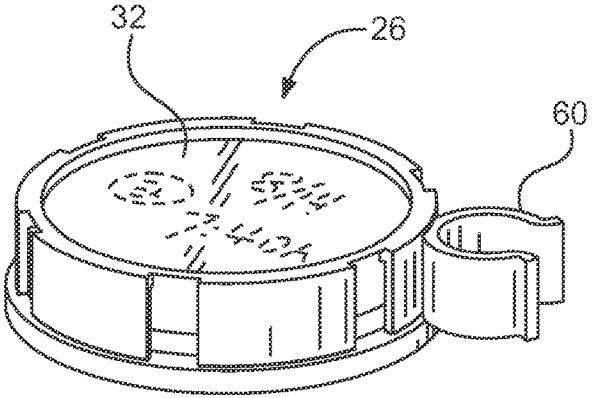
FIG. 81 illustrates another exemplary perspective view of a cap with a write-on surface and a writing implement holder.
Figure 82:
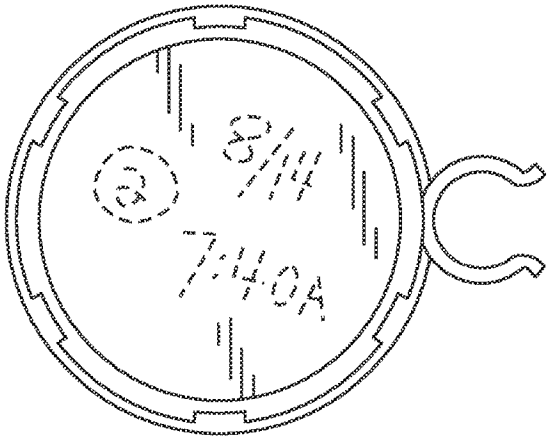
FIG. 82 illustrates a top view of the cap in FIG. 81.
Figure 86:
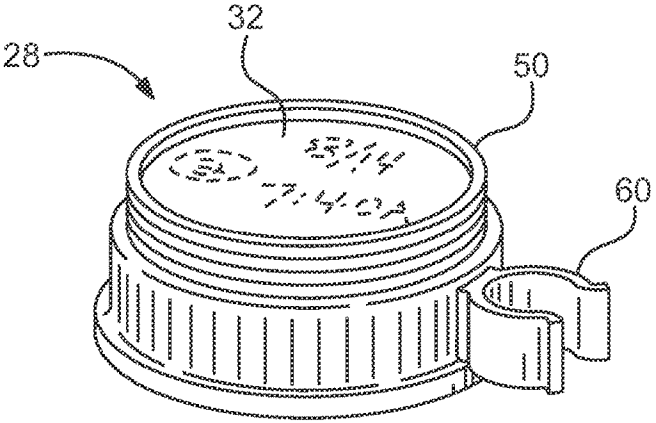
FIG. 86 illustrates yet another exemplary perspective view of a cap with a write-on surface and a writing implement holder.
Figure 87:
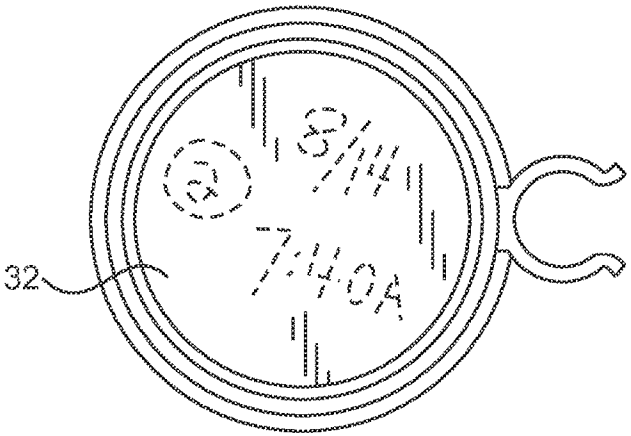
FIG. 87 illustrates a top view of the cap in FIG. 86.
Figure 88:
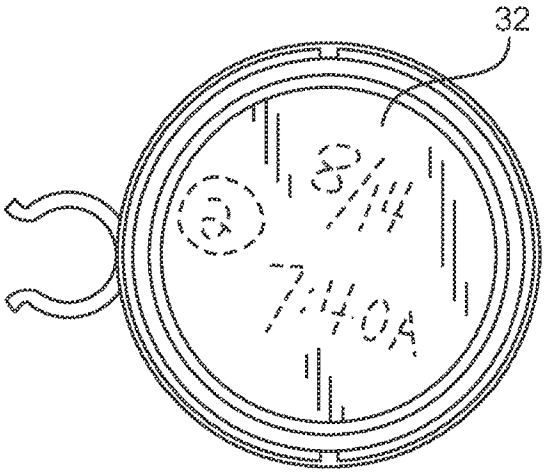
FIG. 88 illustrates a bottom view of the cap in FIG. 86.
Figure 89:
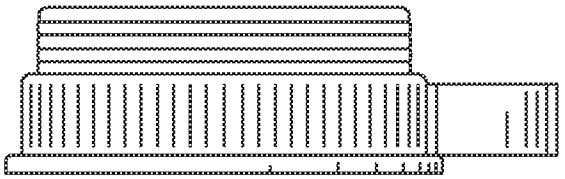
FIG. 89 illustrates a front view of the cap in FIG. 86.
Figure 90:
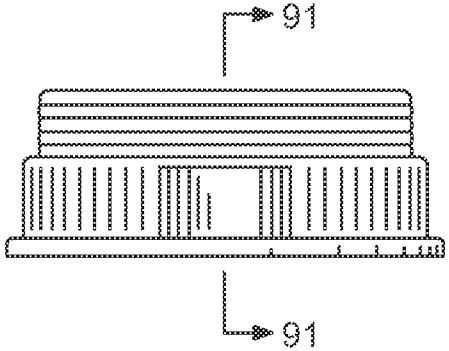
FIG. 90 illustrates a right view of the cap in FIG. 86.
Figure 91:
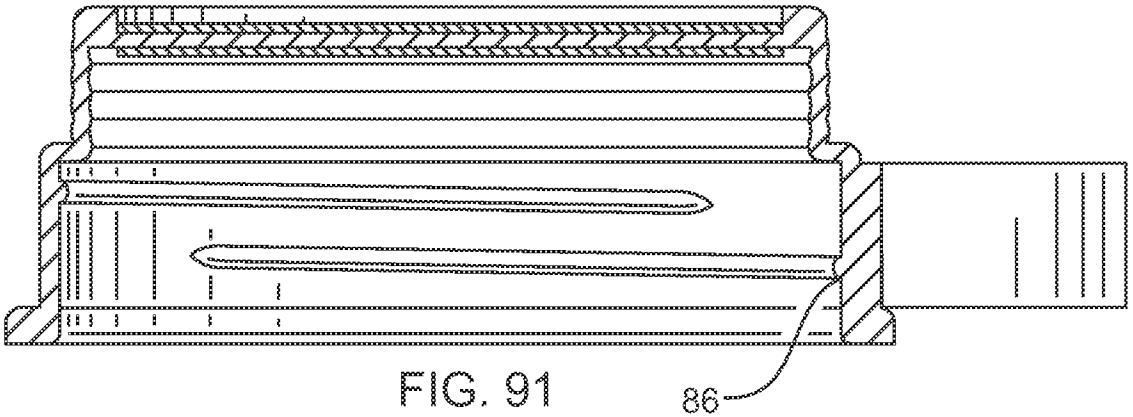
FIG. 91 illustrates a cross-sectional view of the cap in FIG. 86.

The indicia identifier 17, shown in FIGS. 14 and 41 as being disposed on the first peripheral rim 40, may be alternatively provided, without limitations, on the write-on surface 32, second peripheral rim 50 and/or lid 70. The indicia identifier 17 may contain different text and/or symbols to meet various regulatory requirements. For example, the indicia identifier 17 may contain text "Press and Turn" or "Push Down and Turn" or text "Open" and "Close" and two arrows indicating respective directions. The indicia identifier 17 may be printed or molded.

Although illustrated in a combination with a medicine type container, either of a prescription or a non-prescription type, any of the above described articles of manufacture of FIGS. 1-48, 65-74, 81-91 and 95-97 can be shaped and sized for installation on any containers, including without limitations bottles, boxes, cans, jars, disposable and non-disposable food containers, storage containers, presently in use so as to aide in managing and tracking contents of such containers and their use, storage and/or handling. By way of one example only, any of the above described articles of manufacture can be used to mark an expiration date of cookies placed into a conventional "cookie jar".

The cross-sectional shape of any of the above described bodies may be defined by one or more generally flat portions, for positioning on an exterior surface of a container having a square or rectangular cross-section.

By way of an example, articles of manufacture of exemplary embodiments of FIGS. 1-48, 65-74 and 81-91 may be used on a container (not shown) suitable for storing a baking mix of ingredients with the write-on surface being sufficiently sized and shaped not only to be used for indicating the name of the product and storage time frame but also for writing a recipe that uses the mix. Once the mix contents have been consumed, the container can be employed for storing a different product requiring different information to be written on a marking surface. In such examples, the body and/or the write-on surface can define a rigid member with optional raised flange being provided on one or more terminal edges.

By way of another example, the container (not shown) can be of a shallow storage type suitable to refrigerate cooked leftovers where the user can record and track at least one of type, quantity, cooking date, storage duration and the like.

Furthermore, the exemplary embodiments of FIGS. 1-48, 65-74, 81-91 and 95-97 may be provided without the above described implement holder 60, for example when the user has to be concerned with a plurality of containers, each containing a different substance. Then, the user may prefer to use a common detached writing implements 10, 10', 10", 10''' in the exemplary embodiments of FIGS. 49-64, 75-80 and 92-94.

As has been described above, the engagement 80 in the caps in the exemplary embodiments of FIGS. 49-64, 75-80 and 92-94 may be a friction fit between the interior surface 42 of the first peripheral rim 40 with an exterior surface of the cap 3 already in use. The engagement 80 in the caps in exemplary embodiments of FIGS. 49-64, 75-80 and 92-94 may also include the adhesive 38, or equivalent, or, a fastener such as a loop and hook fastener, for attachment onto the exterior surface of the cap 3 already in use.

Although the writing implement holder 60 has been described and illustrated as having a generally C-shaped cross-section, the implement holder 60 can be replaced, in alternative exemplary embodiments with a portion of a hook and loop fastener, a magnetic member attached to at least the exterior surface 44 of the first peripheral rim with an adhesive, or even a strip of an adhesive material operable for repetitive attachment and removal of any of the above described writing implements. The writing implement holder does not have to extend the entire height of the first peripheral rim 40. Alternatively, the writing implement holder may extend past the bottom edge of the first peripheral rim 40. The exterior surface 44 of the first peripheral rim 40 and/or the exterior surface 54 of the second peripheral rim 50 may be either smooth or irregular. For example, such surfaces may be adapted with protrusions, for example of a circular type or ribs, upstanding at least on the exterior surface 44 of the first peripheral rim 40 in a direction normal to the plane of the write-on surface 32; slots in accordance with the teachings of the above referenced U.S. Pat. No. 5,938,055 or U.S. Pat. No. 5,449,078; or define a sand paper feel to facilitate gripping and rotating effort. The exterior surface 44 of the first peripheral rim 40 may be also coated with an elastomeric type material to increase friction with user's fingers to facilitate gripping and rotating effort. The elastomeric coating may be also provided as a separate hollow member seated on the exterior surface 44 of the first peripheral rim 40 and even incorporating the above described indicia identifier 17. Furthermore, the elastomeric coating or a member may be provided on the interior surface 42 of the first peripheral rim 40, particularly for attachment onto the exterior surface of an existing cap.

In one exemplary embodiment, a cap is configured for a releaseable attachment onto an open end of a container, wherein the cap includes an end surface for writing and erasing thereon, and further includes a rim upstanding above the surface and a clip attached to a peripheral side surface of a rim for holding a writing implement.

In another exemplary embodiment, a cap is configured for a releaseable attachment onto an open end of a container, wherein the cap includes a surface for writing and erasing thereon with a rim upstanding above the surface and further includes a transparent lid that is hingeably attached to the rim so as to selectively allow and prevent access to the surface.

In a further exemplary embodiment, a cap is configured for a releaseable attachment onto an open end of a container, wherein the cap includes a write-on surface for writing and/or erasing thereon and further includes a transparent lid that is hingeably attached to the cap and that has a rim configured to upstand on a surface of the lid when the lid is in the closed position so as to allow and prevent access to the surface.

In yet a further exemplary embodiment, a container includes a pocket configured to releaseably receive a writing implement therein.

In another exemplary embodiment, a cap is configured for a releaseable attachment onto an open end of a container, wherein the cap includes an end surface for writing and erasing thereon and further includes a clip attached to a peripheral side surface for holding a writing implement.

In yet another exemplary embodiment, a cap is configured for a releaseable attachment onto an open end of a container, wherein the cap includes an end surface for writing and erasing thereon and an optional rim upstanding above the surface and/or an optional lid to selectively allow and prevent access to the surface and wherein the container is provided with a pocket configured to releaseably receive a writing implement therein.

The chosen exemplary embodiments of the claimed invention have been described and illustrated for practical purposes so as to enable any person skilled in the art to which it pertains to make and use the same. It is therefore intended that all matters in the foregoing description and shown in the accompanying drawings be interpreted as illustrative and not in a limiting sense. It will be understood that variations, modifications, equivalents and substitutions for components of the specifically described exemplary embodiments of the invention may be made by those skilled in the art without departing from the spirit and scope of the invention as set forth in the appended claims.

Furthermore, the Abstract is not intended to be limiting as to the scope of the claimed invention and is for the purpose of quickly determining the nature of the claimed invention.

What is claimed is:

1. An article of manufacture for a container having a cap closing an open end of the container, comprising:

a substrate;

a thin flexible member configured to be attached to one surface of said substrate in one of a permanent and a releaseable manner and comprising a surface configured for writing and erasing thereof;

a peripheral rim extending from said substrate and defining a hollow interior sized and shaped to receive the cap therewithin; and an adhesive disposed on an interior surface of said peripheral rim, on a surface of said substrate opposite to said surface configured for writing and erasing thereof, said adhesive configuring said article of manufacture for attachment on a surface of the cap when the cap is received within said hollow interior.

2. The article of manufacture of claim 1, further comprising a holder disposed on at least an exterior surface of said peripheral rim, said holder configured to releaseably retain a writing implement therewithin.

3. The article of manufacture of claim 2, wherein said holder comprises an opening facing away from said exterior surface.

4. The article of manufacture of claim 3, wherein a cross-sectional shape of said holder in a plane parallel to a plane of said surface configured for writing and erasing thereon includes a first curved portion abutting an exterior surface of said rim, a pair of second curved portions defining a narrow opening of said holder and a pair of flanges extending outwardly from said pair of second curved portions.

5. The article of manufacture of claim 3, wherein said holder includes an annular cross-sectional shape in a plane parallel to a plane of said surface configured for writing and erasing thereon.

6. The article of manufacture of claim 3, wherein at least a portion of said holder is manufactured from one of a flexible material, a resilient material and a combination thereof.

7. The article of manufacture of claim 1, further comprising a lid hingeably attached to at least one of said peripheral rim and said member, said lid movable between a first position wherein an interior surface of said lid is being generally coplanar with said surface configured for writing and erasing thereon so as to prevent an access thereto and a second position being disposed at one of an acute, right and obtuse angle to said surface configured for writing and erasing thereon so as to allow the access thereto, wherein said interior surface of said lid is spaced a distance from said surface configured for writing and erasing thereon when said lid is disposed in said first position.

8. The article of manufacture of claim 1, further comprising a lid having another peripheral rim extending from an interior surface thereof, said another peripheral rim having a hinged connection with at least one of said peripheral rim and said member, whereby said lid is selectively movable between a first position wherein said interior surface thereof is disposed generally coplanar with said surface configured for writing and erasing thereon so as to prevent an access thereto and a second position wherein said interior surface is disposed at one of an acute, right and obtuse angle to said surface configured for writing and erasing so as to allow the access thereto.

9. The article of manufacture of claim 1, wherein said peripheral rim is manufactured from one of a light-transmissive material, a light-resistant material and a combination thereof.

10. The article of manufacture of claim 1, further comprising another peripheral rim upstanding on said surface configured for writing and erasing thereon.

11. The article of manufacture of claim 10, further comprising a lid hingeably attached to said another peripheral rim, whereby said lid is selectively movable between a first position wherein an interior surface thereof is disposed generally coplanar with said surface configured for writing and erasing thereon so as to prevent an access thereto and a second position wherein said interior surface is disposed at one of an acute, right and obtuse angle to said surface configured for writing and erasing thereon so as to allow the access thereto.

12. The article of manufacture of claim 1, further comprising at least one of the container, the cap and a writing implement.

13. An article of manufacture for a container having a cap closing an open end of the container, comprising:

a member comprising a substrate and a surface on said substrate, said surface configured for writing and erasing thereon;

a peripheral rim extending from said substrate and defining a hollow interior sized and shaped to receive the cap therewithin; and an engagement between an interior surface of said peripheral rim and an exterior surface of the cap when the cap is received within said hollow interior.

14. The article of manufacture of claim 13, wherein said engagement comprises a friction fit between said interior surface of said peripheral rim and said exterior surface of the cap.

15. The article of manufacture of claim 13, wherein said surface configured for writing and erasing thereon is provided by a generally thin flexible member configured to be attached to said substrate in one of a permanent and a releaseable manner.

16. The article of manufacture of claim 15, further comprising an adhesive and wherein said generally thin flexible member is attached to said substrate with said adhesive in said one of said permanent and said releaseable manner.

17. The article of manufacture of claim 13, wherein said engagement comprises an adhesive disposed on a surface of said substrate, said surface of said substrate being opposite to said surface configured for writing and erasing thereon.

18. An article of manufacture for a container having a cap closing an open end of the container, comprising:

a substrate;

a thin flexible member configured to be attached to one surface of said substrate in one of a permanent and a releaseable manner and comprising a surface configured for writing and erasing thereof;

an adhesive disposed on a surface of said substrate opposite to said surface configured for writing and erasing thereof, said adhesive configuring said article of manufacture for attachment on a surface of the cap or on a surface of the container; and a writing implement holder disposed on an exterior surface of said substrate between said one surface and said opposite surface of said substrate.

19. The article of manufacture of claim 18, further comprising a container comprising a closed end, an open end, a peripheral wall defining a height of said container and a hollow interior thereof, said container further comprising an elongated pocket or channel disposed along and aligned with a portion of said peripheral wall or inclined at an angle thereto.

20. The article of manufacture of claim 19, further comprising an elongated pocket or channel disposed along and aligned with a portion of said peripheral wall or inclined at an angle thereto, said elongated pocket is disposed within said hollow interior and has an opening disposed adjacent one of said closed and open ends of said container.

21. The article of manufacture of claim 20, further comprising an elongated pocket or channel disposed along and aligned with a portion of said peripheral wall or inclined at an angle thereto, said elongated pocket is inclined at an angle to said peripheral wall and has an opening formed therethrough proximal said open or closed end of said container.

* * * * *